US008095045B2

(12) United States Patent
Takashima

(10) Patent No.: US 8,095,045 B2
(45) Date of Patent: Jan. 10, 2012

(54) ROTARY DEVELOPING UNIT AND TONER SUPPLY CONTAINER

(75) Inventor: Yoshiyuki Takashima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 939 days.

(21) Appl. No.: 12/103,413

(22) Filed: Apr. 15, 2008

(65) Prior Publication Data

US 2009/0028608 A1 Jan. 29, 2009

(30) Foreign Application Priority Data

Jul. 23, 2007 (JP) ..... 2007-191347

(51) Int. Cl.
*G03G 15/01* (2006.01)

(52) U.S. Cl. ..... 399/227

(58) Field of Classification Search ..... 399/106, 399/113, 227
See application file for complete search history.

(56) References Cited

U.S. PATENT DOCUMENTS

| | | | | |
|---|---|---|---|---|
| 5,765,059 | A * | 6/1998 | Kosuge et al. | 399/224 |
| 6,336,020 | B1 * | 1/2002 | Ishikawa et al. | 399/227 |
| 7,072,605 | B2 * | 7/2006 | Kishigami | 399/227 |
| 7,496,319 | B2 * | 2/2009 | Takashima et al. | 399/227 |

FOREIGN PATENT DOCUMENTS

| | | | |
|---|---|---|---|
| JP | 07-295374 | A | 11/1995 |
| JP | 07-319275 | A | 12/1995 |
| JP | 08-160699 | A | 6/1996 |
| JP | 08-305114 | A | 11/1996 |
| JP | 09-106159 | A | 4/1997 |
| JP | 2007-212791 | A | 8/2007 |

* cited by examiner

*Primary Examiner* — David Gray
*Assistant Examiner* — Gregory H Curran
(74) *Attorney, Agent, or Firm* — Sughrue Mion, PLLC

(57) ABSTRACT

A rotary developing unit includes: a first developing device; a second developing device; a toner supply container that is inserted between the first developing device and the second developing device to be attached to the first developing device; a first guide formed on the toner supply container; a second guide formed on the second developing device, that is configured to slide along the first guide when the toner supply container is inserted, and to be detached from the first guide before the toner supply container is attached to the first developing device; a first position fixing unit provided at the first developing device; and a second position fixing unit provided at the toner supply container, that is configured to fix a position of the toner supply container, before the second guide of the second developing device is detached from the first guide.

7 Claims, 17 Drawing Sheets

ROTARY DEVELOPING UNIT AND TONER SUPPLY CONTAINER

CROSS-REFERENCE TO RELATED APPLICATIONS

This application is based on and claims priority under 35 USC 119 from Japanese Patent Application No. 2007-191347 filed on Jul. 23, 2007.

BACKGROUND

1. Technical Field

The present invention relates to a technique for replacing a toner supply container of rotary image forming apparatus having a rotary body with plural developing devices.

2. Related Art

A so-called rotary image forming apparatus that develops an electrostatic latent image formed on a photosensitive drum, using a rotary developing unit having plural developing devices provided at the circumferential surface of a rotary body is known. In such apparatus, developing operations using toner of each color are sequentially performed by, for example, rotation of a rotary developing unit so that one of the plural developing devices faces a photosensitive drum, and causing the developing device to develop an electrostatic latent image formed on the surface of the photosensitive drum with toner of a first color, and subsequently by rotation of the rotary developing unit so that another of the plural developing devices faces the photosensitive drum, and causing the developing device to develop the electrostatic latent image formed on the surface of the photosensitive drum with toner of a second color, and so on. As a result, toner images are layered on the photosensitive drum.

A commonly-used rotary developing unit has a toner supply container which is known as a toner cartridge, and an appropriate amount of toner is supplied from the toner supply container to each developing device.

SUMMARY

An aspect of the present invention provides a rotary developing unit including: a rotary body that rotates around a rotation axis; a first developing device arranged on a circumferential surface of the rotary body, including: a first toner storage chamber that houses toner supplied from a first toner entry port; and a first developer holder that develops an electrostatic latent image formed on an image holder with toner supplied from the first toner storage chamber; a second developing device arranged on a circumferential surface of the rotary body, including: a second toner storage chamber that houses toner supplied from a second toner entry port; and a second developer holder that develops an electrostatic latent image formed on an image holder with toner supplied from the second toner storage chamber; a toner supply container that is inserted between the first developing device and the second developing device in an insertion direction substantially parallel to that of the rotation axis to be attached to the first developing device, and that supplies toner to the first toner storage chamber of the first developing device through a supply port of the toner supply container and the first toner entry port of the toner storage chamber; a first guide formed on the toner supply container; a second guide formed on the second developing device, that is configured to slide along the first guide when the toner supply container is inserted between the first developing device and the second developing device, and to be detached from the first guide before the toner supply container is attached to the first developing device; a first position fixing unit provided at the first developing device; and a second position fixing unit provided at the toner supply container, that is configured to fix a position of the toner supply container in a direction substantially perpendicular to the insertion direction, in cooperation with the first position fixing unit of the first developing device, before the second guide of the second developing device is detached from the first guide.

BRIEF DESCRIPTION OF THE DRAWINGS

Exemplary embodiments of the present invention will now be described in detail with reference to the following figures, wherein.

DETAILED DESCRIPTION

Exemplary Embodiment

An exemplary embodiment of the present invention will be described below with reference to the drawings.

<Structure>

<Multifunction Machine>

A structure of an image forming apparatus will be briefly described.

Figure 1:
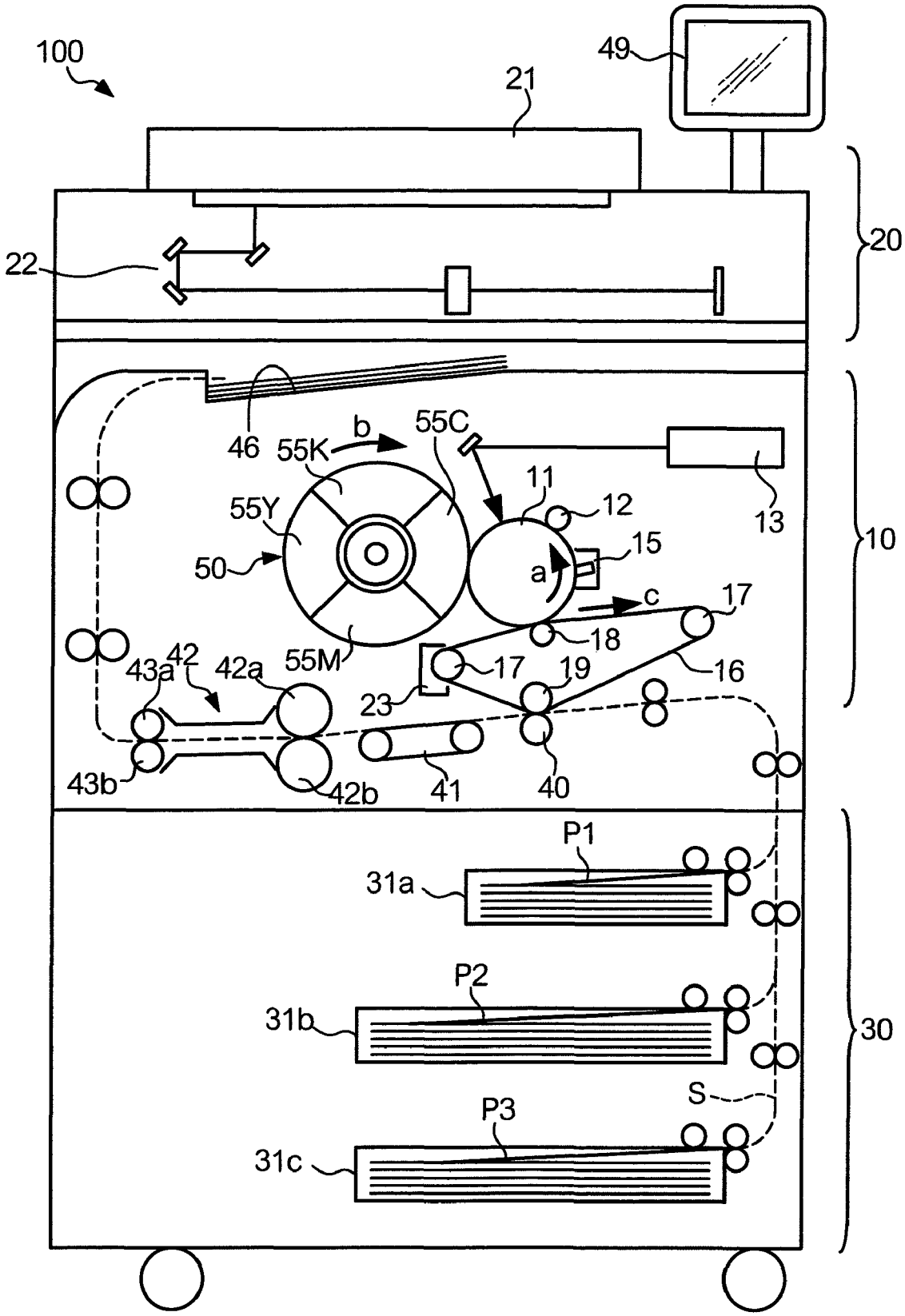
FIG. 1 is a diagram illustrating a rotary image forming apparatus according to an exemplary embodiment of the present invention.

FIG. 1 is a structure diagram of multifunction machine 100 having a rotary image forming unit according to an exemplary embodiment of the present invention. Multifunction machine 100 has plural functions such as a color printer and a color copier. The structure of multifunction machine 100 is, as shown in FIG. 1, roughly divided into image forming unit 10, image read unit 20, and paper supply unit 30. Paper supply unit 30 has paper supply sources of paper trays 31*a*, 31*b*, and 31*c*, and conveyance rolls and a resist roll that convey paper P1, P2, or P3 from a paper supply source to image forming unit 10 along a conveyance path, indicated by dotted line S of FIG. 1. Image read unit 20 has document feeder 21 and optical system 22 with a CCD (Charge Coupled Device). Image read unit 20 reads an image of a document placed on a platen glass (not shown) by document feeder 21 using optical system 22, and generates image data representing the read image.

Image forming unit 10 performs an image forming operation on the basis of image data generated by image read unit 20 or image data received via a communication interface (not shown). Image forming unit 10 has photosensitive drum 11, charging device 12, exposing device 13, rotary developing unit 50, cleaning blade 15, intermediate transfer belt 16, support rolls 17, first transfer roll 18, second transfer roll 19, counter roll 40, conveyor belt 41, and fixing device 42. Photosensitive drum 11 has a photosensitive layer on its outer circumferential surface, and is rotated in the direction shown by arrow a by a drive mechanism (not shown). Charging device 12 is, for example, a roll-type charging device or a scorotron charging, and uniformly charges the surface of photosensitive drum 11 at a predetermined electric potential. Exposing device 13 irradiates the uniformly charged surface of photosensitive drum 11 with a laser modulated on the basis of image data, thereby forming an electrostatic latent image on the surface of photosensitive drum 11.

Rotary developing unit 50 has developing devices 55Y, 55M, 55C, and 55K that respectively house colored toner (developer) of Y (Yellow), M (Magenta), C (Cyan), or K (Black). Rotary developing unit 50 is rotated by a drive mechanism (not shown) in the direction shown by arrow b of FIG. 1, and developing devices 55Y, 55M, 55C, and 55K are sequentially moved to a position facing photosensitive drum 11 (developing position) by the rotation of rotary developing unit 50. Each toner housed in developing devices 55Y, 55M, 55C, and 55K is electrically transferred to an electrostatic latent image of the toner's color; as a result, a toner image is formed on the surface of photosensitive drum 11.

Intermediate transfer belt 16 is an endless belt, and is rotated in the direction shown by arrow c of FIG. 1 while the inner circumferential surface of the belt is suspended by plural support rolls 17 (two rolls in FIG. 1), first transfer belt 18, and second transfer belt 19. First transfer belt 18 holds intermediate transfer belt 16 between first transfer belt 18 and photosensitive drum 11, and transfers a toner image formed on the surface of photosensitive drum 11 to the outer circumferential surface of intermediate transfer belt 16 (first transfer). Cleaning blade 15 provided adjacent to photosensitive drum 11 removes toner remaining after a first transfer from the surface of photosensitive drum 11. Second transfer roll 19 transfers a toner image transferred to the outer circumferential surface of intermediate transfer belt 16 to a paper (second transfer) at a nip area formed between second transfer roll 19 and counter roll 40. Toner remaining on the surface of intermediate transfer belt 16 after a second transfer is removed by belt cleaner 23. Fixing device 42 rapidly applies pressure and heat to a paper on which a toner image is second-transferred, by fixing roll 42*a* and pressure roll 42*b*, thereby fixing the toner image on the paper. A paper subjected to a fixing operation is output to paper output tray 46 by eject rolls 43*a* and 43*b*.

<Rotary Developing Unit>

Figure 2A:
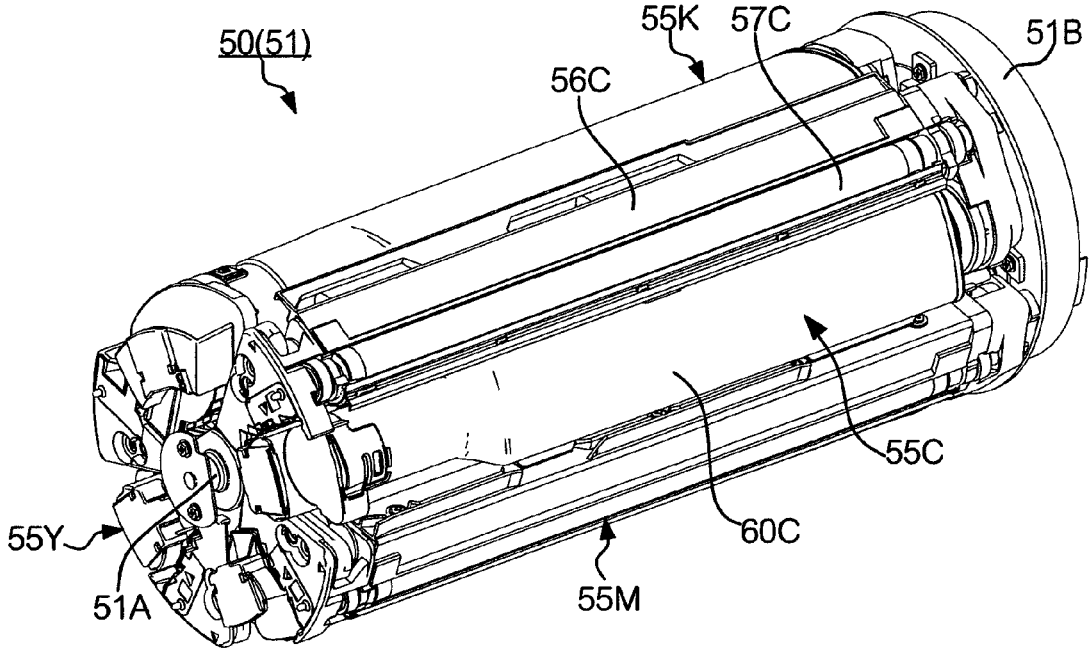
FIGS. 2A and 2B are perspective views of a rotary developing unit according to the exemplary embodiment.
Figure 2B:
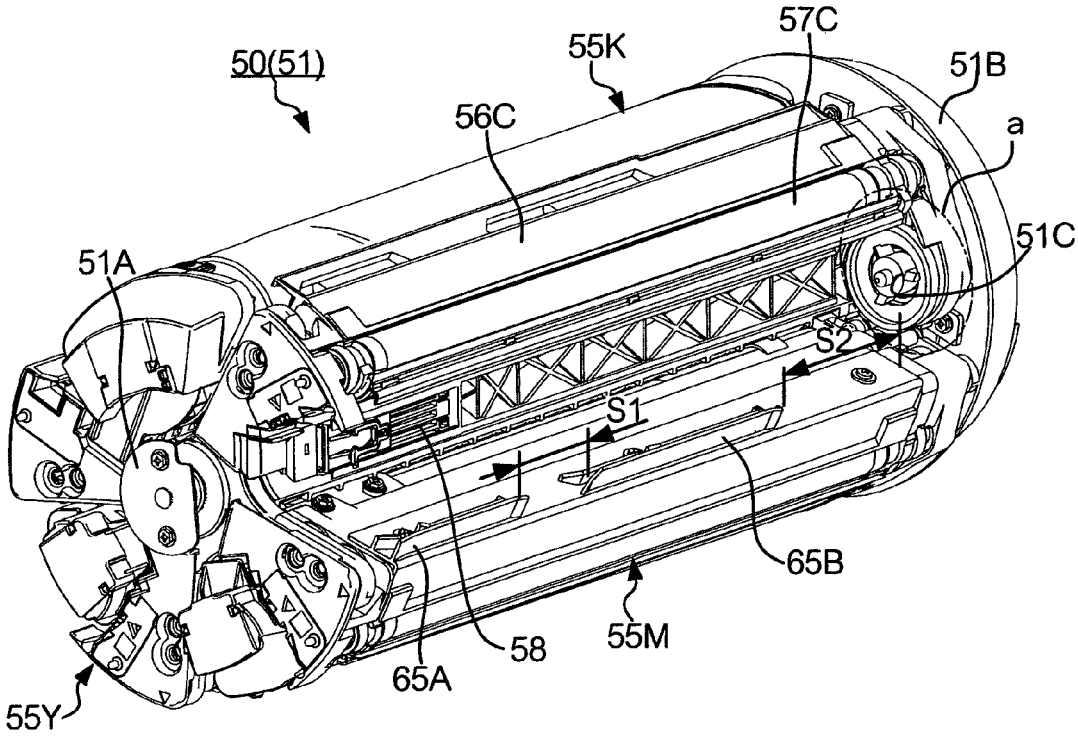
Figure 3:
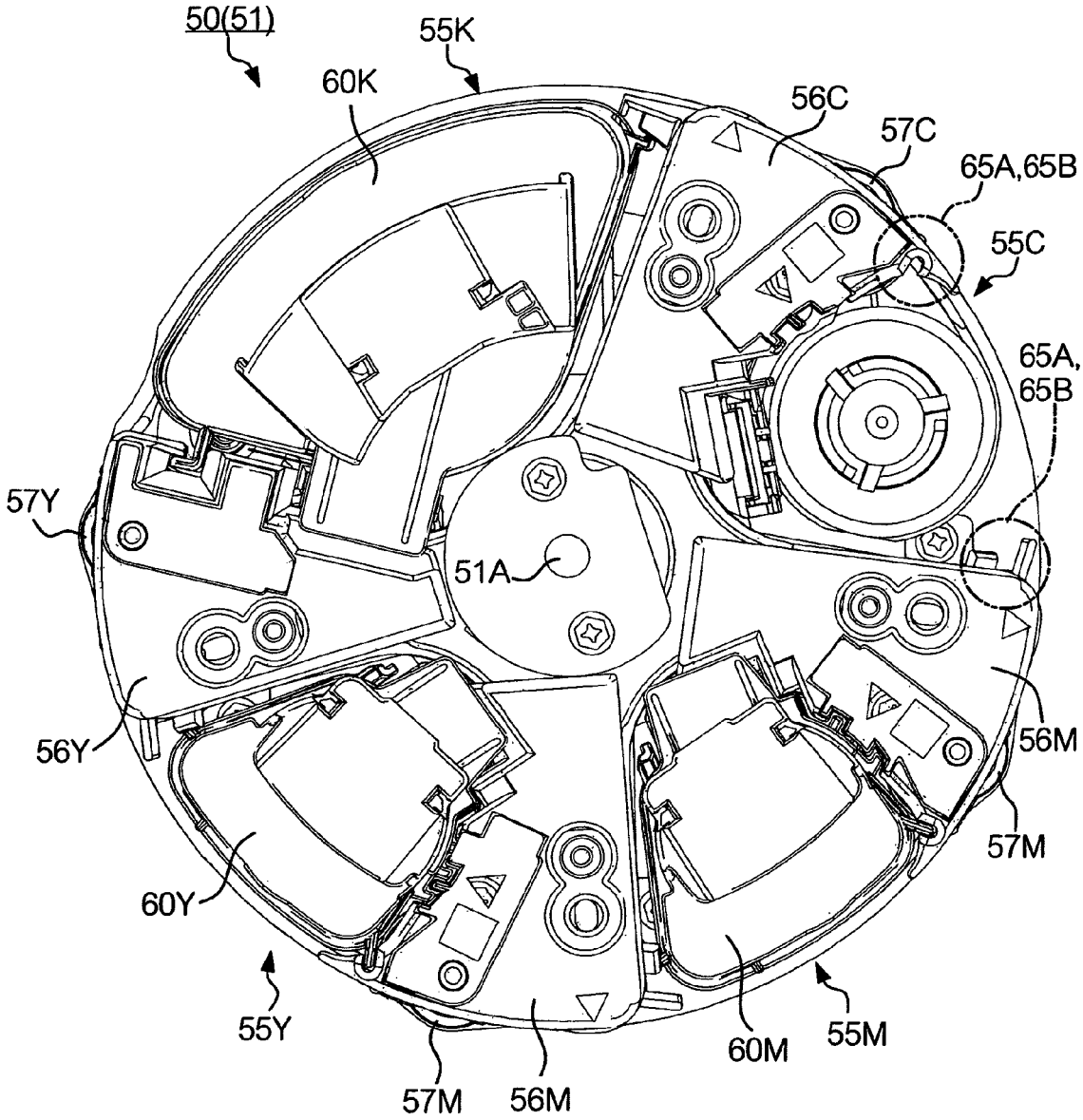
FIG. 3 is a lateral view of a rotary developing unit according to the exemplary embodiment.

A structure of rotary developing unit 50 will be described with reference to FIGS. 2A and 2B and 3A and 3B. FIGS. 2A and 2B are perspective views of rotary developing unit 50, and FIG. 3 is a lateral view of rotary developing unit 50.

Rotation axis 51A of rotary body 51 is supported by case 101 (described later) of multifunction machine 100 so as to be rotatable. On the circumferential surface of rotary body 51, four developing devices 55Y, 55M, 55C, and 55K are arranged. On the back end of rotary axis 51A, disk-shaped end 51B is attached. End 51B has male coupling 51C to be coupled with an auger shaft (described later) of toner cartridge 60.

Hereinafter, each developing device 55Y, 55M, 55C, and 55K is referred to as "developing device 55", except where it is necessary to specify otherwise.

Developing device 55Y, 55M, 55C, or 55K has: developing device main body 56Y, 56M, 56C, or 56K that has a toner storage chamber and developing roll 57Y, 57M, 57C, or 57K; and toner cartridge 60Y, 60M, 60C, or 60K that is a toner supply container attached to developing device main body 56Y, 56M, 56C, or 56K. Each toner cartridge 60Y, 60M, 60C, and 60K has a fan-like cross-section, and has a prismatic shape. In FIGS. 2B and 3, toner cartridge 60C is unattached to developing device 55C.

Figure 5A:
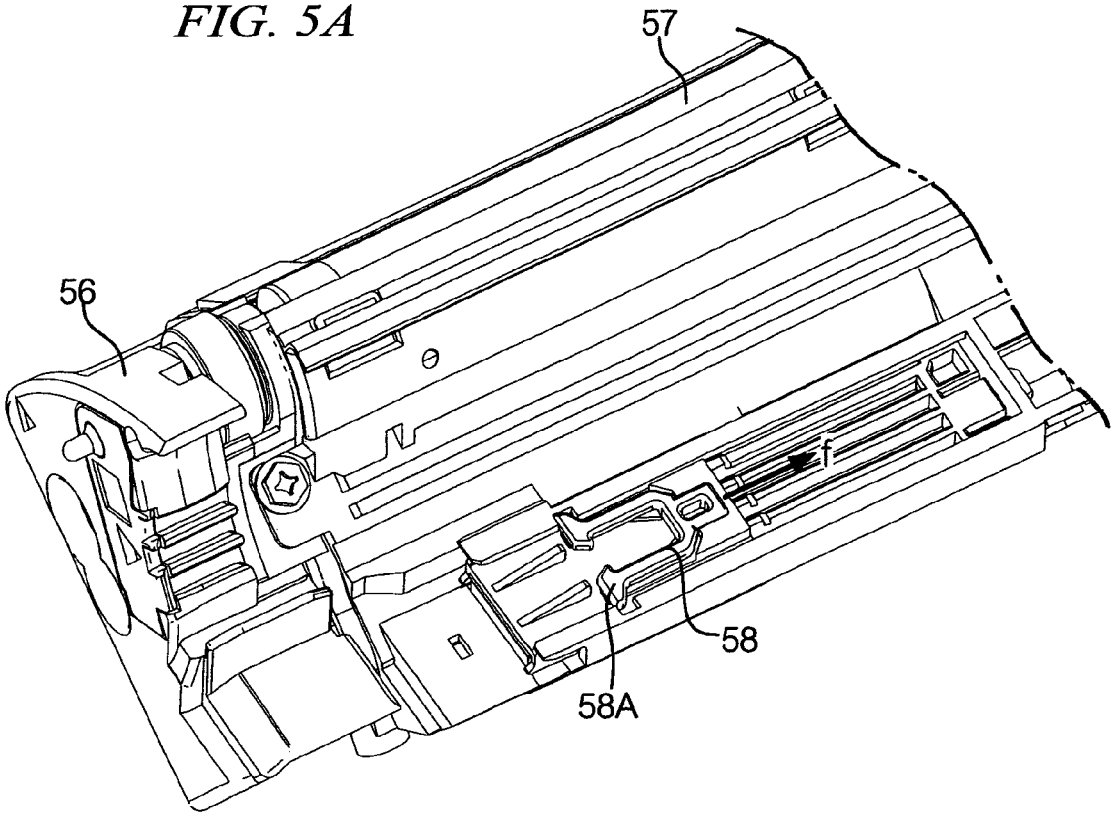
FIGS. 5A and 5B are diagrams illustrating a main part of a developing device according to the exemplary embodiment.
Figure 5B:
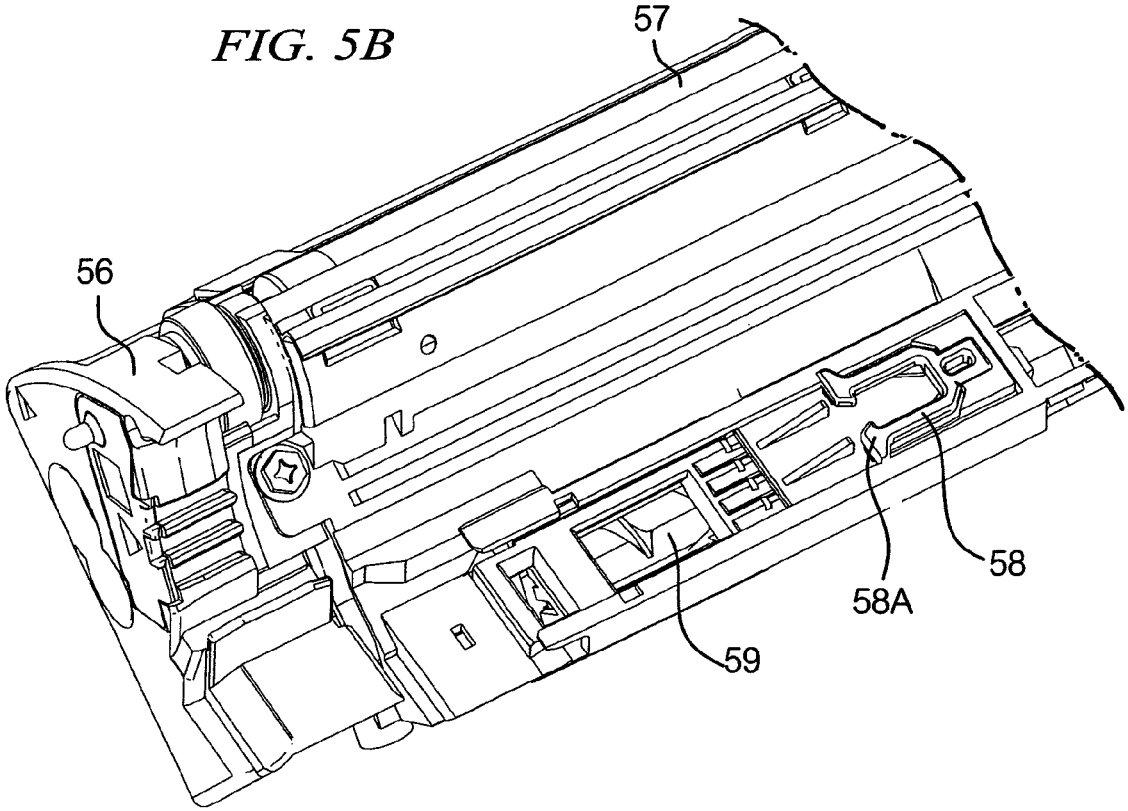

Developing device main body 56 has toner entry port 59 through which toner is supplied into a toner supply container, as shown in FIG. 5B. Toner entry port 59 is sealed with shutter 58, and exposed if shutter 58 is moved in the direction shown by arrow f of FIG. 5A. Shutter 58 has projecting engaging claw 58A that engages with shutter 61 of toner cartridge 60 (described later) when the cartridge is inserted into rotary developing unit 50.

Toner cartridge 60, which is a toner supply container, is, after rotary developing unit 50 is rotated to a predetermined position, inserted into a fixing point in developing device 55 from a predetermined direction. Toner cartridge 60 is removed from the fixing point in developing device 55 by being pulled out in a direction opposite to the insertion direction.

Figure 6A:
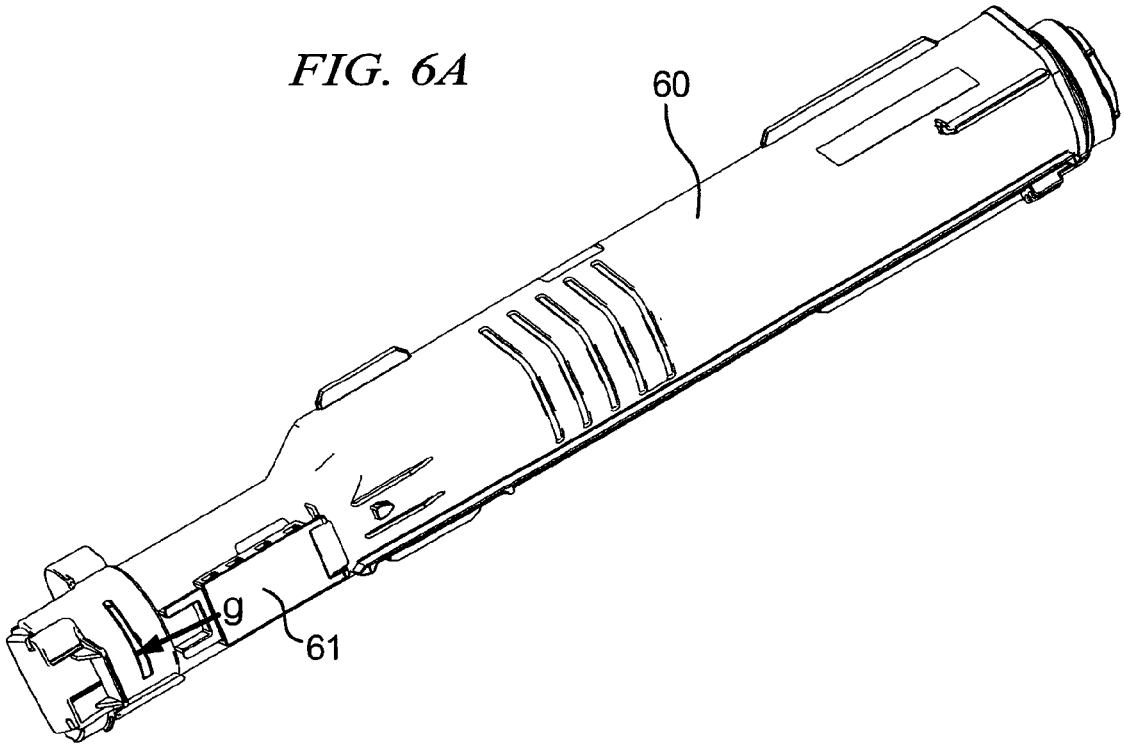
FIGS. 6A and 6B are perspective views of a toner cartridge according to the exemplary embodiment viewed from an angle different from that of FIGS. 4A and 4B.
Figure 6B:
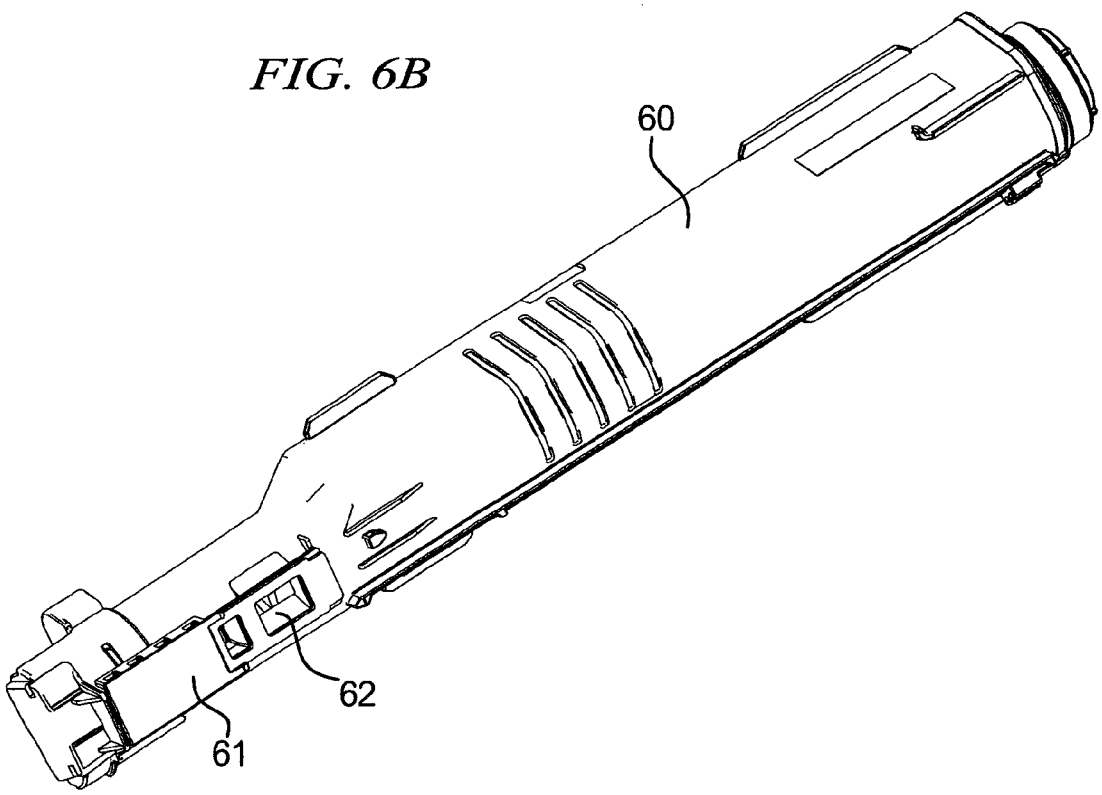

Toner cartridge 60 has supply port 62 at a start end in an insertion direction of a side. Supply port 62 is sealed with shutter 61, and exposed if shutter 61 is moved in the direction shown by arrow g (see FIGS. 6A and 6B). Shutter 61 of toner cartridge 60 is, when toner cartridge 60 is attached to developing device main body 56 (rotary developing unit 50), engaged with shutter 58 of developing device main body 56 and moved together with shutter 58 so that supply port 62 is exposed to toner entry port 59. Toner housed in toner cartridge 60 is supplied to a toner storage chamber through supply port 62 and toner entry port 59.

Figure 4A:
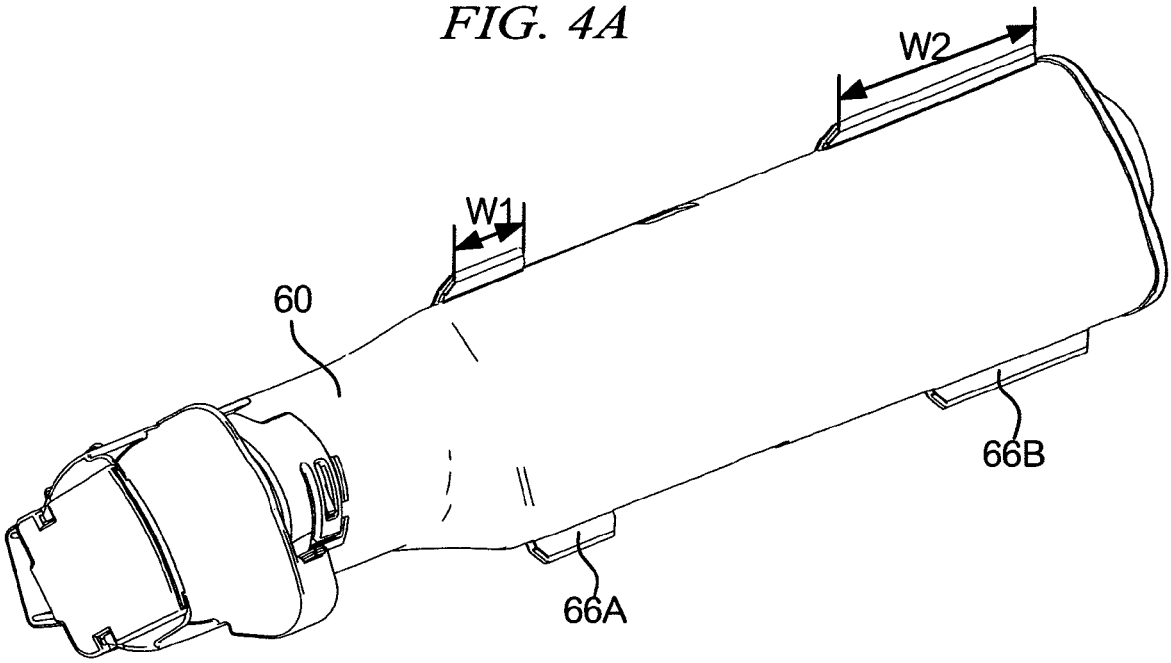
FIGS. 4A and 4B are perspective views of a toner cartridge according to the exemplary embodiment.
Figure 4B:
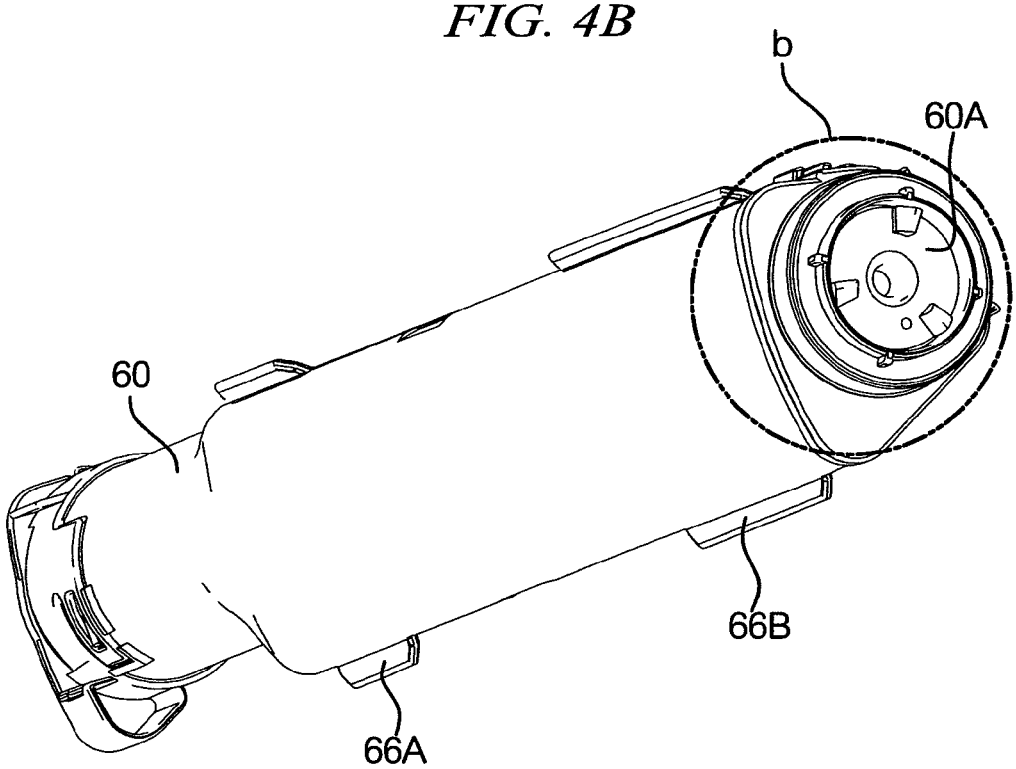

Toner cartridge 60 also has a stirring auger (not shown) for churning toner housed in the cartridge, which is provided in toner cartridge 60 in a longitudinal direction so as to be rotatable. Toner cartridge 60 has female coupling 60A at an end face in an insertion direction, which is connected to male coupling 51C of developing device main body 56, and which is connected to the shaft of the stirring auger (see FIG. 4B). Rotation generated by a driving mechanism (not shown) located outside of rotary developing unit 50 is transmitted to the stirring auger via male coupling 51C and female coupling 60A; as a result, toner housed in toner cartridge 60 is churned and conveyed to supply port 62 by the stirring auger.

Figure 7A:
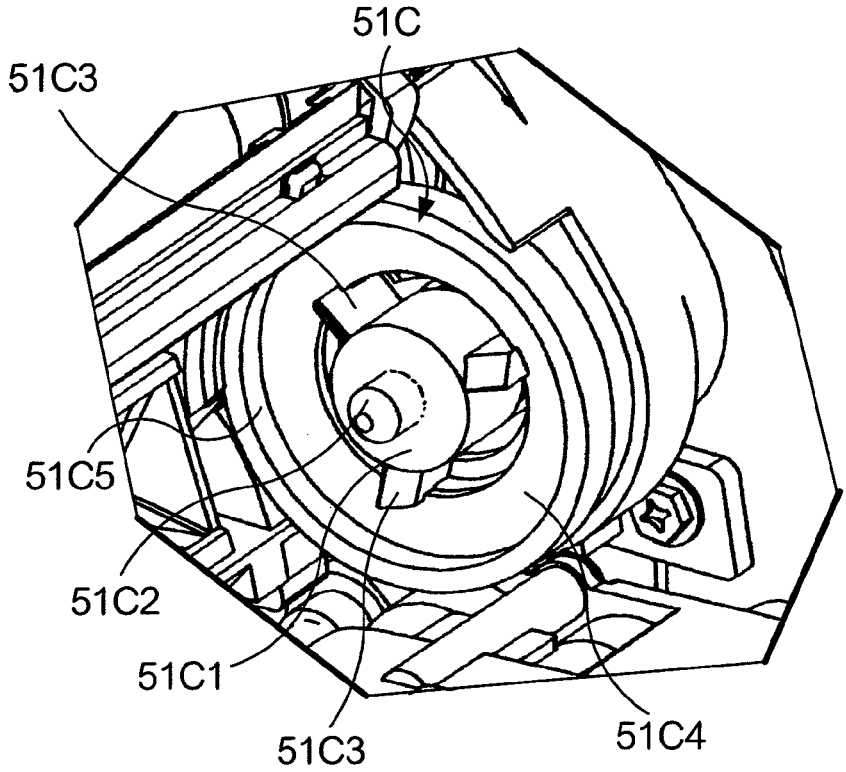
FIG. 7A is an enlarged view of section a of FIG. 2B.

Now, structures of male coupling 51C and female coupling 60A will be described with reference to FIGS. 7A and 7B. FIG. 7A is an enlarged view of section a of FIG. 2B, and FIG. 7B is an enlarged view of section b of FIG. 4B.

Male coupling 51C has a disk-shaped form as shown in FIG. 7A. Male coupling 51C has cylindrical base portion 51C1 that extends in the direction of a rotation axis in the center. Base portion 51C1 has projecting shaft center 51C2 in the center. Base portion 51 also has three equally spaced beams 51C3 that extend outward at the circumferential surface. On the outside of beams 51C3, annular section 51C4 that is thinner than beams 51C3 is provided, and on the outside of annular section 51C4, rib 51C5 is provided.

A tip of a beam 51C3 has a triangle-shaped cross section, and protrudes relative to annular section 51C4 to the same extent as base portion 51C1. Beam 51C3 is engaged with engaged portion 60A4 of female coupling 60A so that rotation of male coupling 51C is transmitted to female coupling 60A.

Figure 7B:
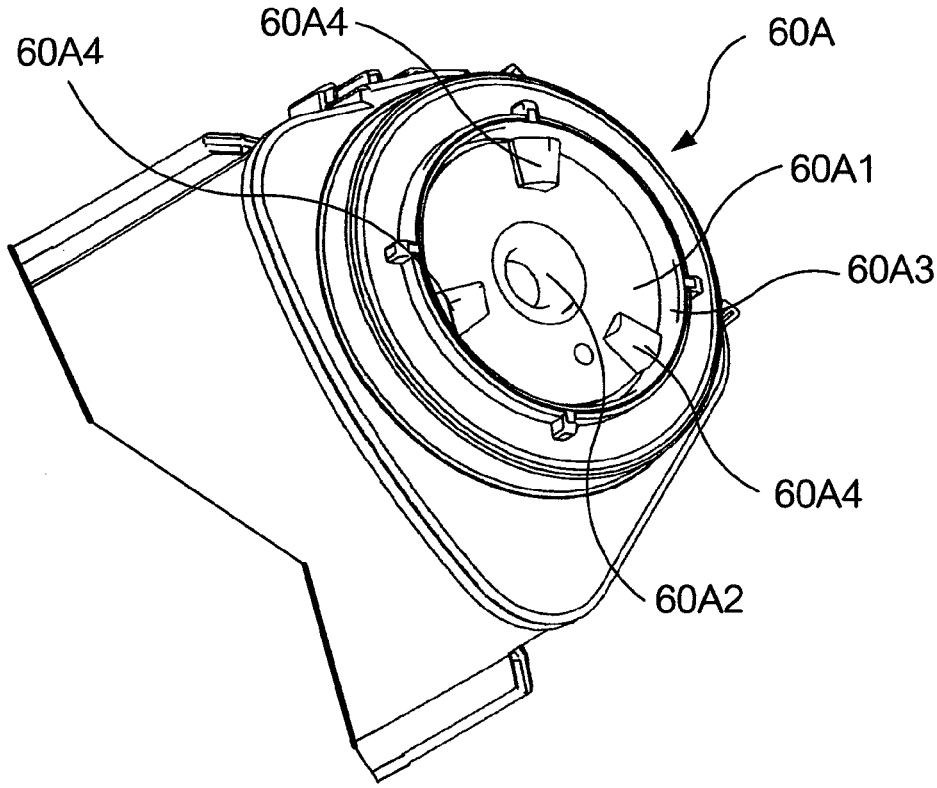
FIG. 7B is an enlarged view of section b of FIG. 4B.

Female coupling 60A has a disk-shaped form as shown in FIG. 7B, as in the case of male coupling 51C. Female coupling 60A has disk portion 60A1 that has recess 60A2 into which shaft center 51C2 is inserted in the center. On the outside of disk portion 60A1, rib 60A3 is provided. Disk portion 60A1 also has three equally spaced engaged portions 60A4 that extend from rib 60A3 to recess 60A2, and each engaged portion 60A4 has a triangular cross-section at its periphery.

When toner cartridge 60 is attached in a fixing position in developing device 55, shaft center 51C2 of male coupling 51C is inserted into recess 60A2 of female coupling 60A; consequently, a position in a direction perpendicular, or substantially perpendicular, to the insertion direction of toner cartridge 60 is fixed. Also, engaged portions 60A4 of female coupling 60A are engaged with beams 51C3 of male coupling 51C; consequently, female coupling 60A and male coupling 51C are coupled.

<Structure of Guide>

Between developing device main body 56 and toner cartridge 60 which are adjacent to each other, guides are provided. In an example shown in FIG. 2B, guides are provided between toner cartridge 60C and developing device main body 56C and between toner cartridge 60C and developing device main body 56M so that toner cartridge 60C of C color can be inserted between developing device main body 56C and developing device main body 56M.

The guides include a pair of grooves 65A and 65B that are formed on developing device main body 56 and a pair of plate-like engaging protrusions 66A and 66B that are formed on toner cartridge 60C. The pair of grooves 65A and 65B are arranged in the same straight line extending in an insertion direction of toner cartridge 60, and separated from each other. Similarly, the pair of engaging protrusions 66A and 66B are arranged in the same straight line extending in an insertion direction of toner cartridge 60, and separated from each other. Engaging protrusions 66A and 66B may be referred to as "first guides", and grooves 65A and 65B may be referred to as "second guides".

The length of engaging protrusion 66A, the length of engaging protrusion 66B, the distance between groove 65A and groove 65B, and the distance between groove 65B and rib 51C5 of male coupling 51C are set so that, given that the length of engaging protrusion 66A is W1, the length of engaging protrusion 66B is W2 (see FIG. 4A), the distance between groove 65A and groove 65B is S1, and the distance between groove 65B and rib 51C5 of male coupling 51C is S2 (see FIG. 2B), S1 is larger than W1 and S2 is larger than W2.

When toner cartridge 60 is attached in a fixing position in developing device 55; namely, when female coupling 60A of toner cartridge 60 is coupled with male coupling 51C of rotary developing unit 50, engaging protrusion 66A is positioned between grooves 65A and 65B, and engaging protrusion 66B is positioned between groove 65B and rib 51C5 of male coupling 51C. That is, engaging protrusions 66A and 66B are out of contact with grooves 65A and 65B.

Now, coupling of male coupling 51C and female coupling 60A that occurs when toner cartridge 60 is attached to developing device 55 will be described with reference to FIGS. 8A to 8C.

Figure 8A:
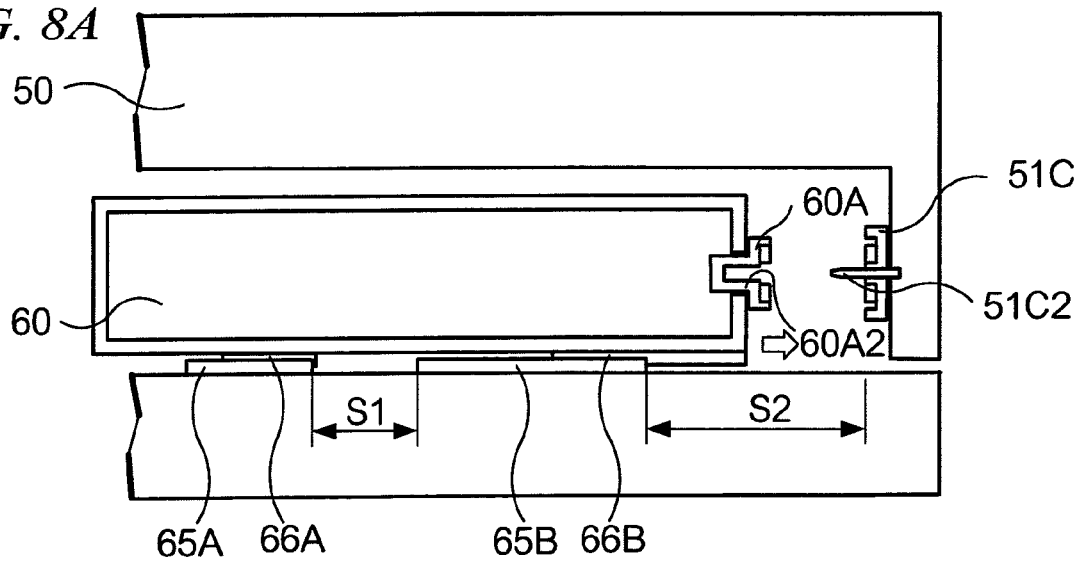
FIGS. 8A to 8C are diagrams illustrating a toner cartridge being inserted into a developing device.
Figure 8B:
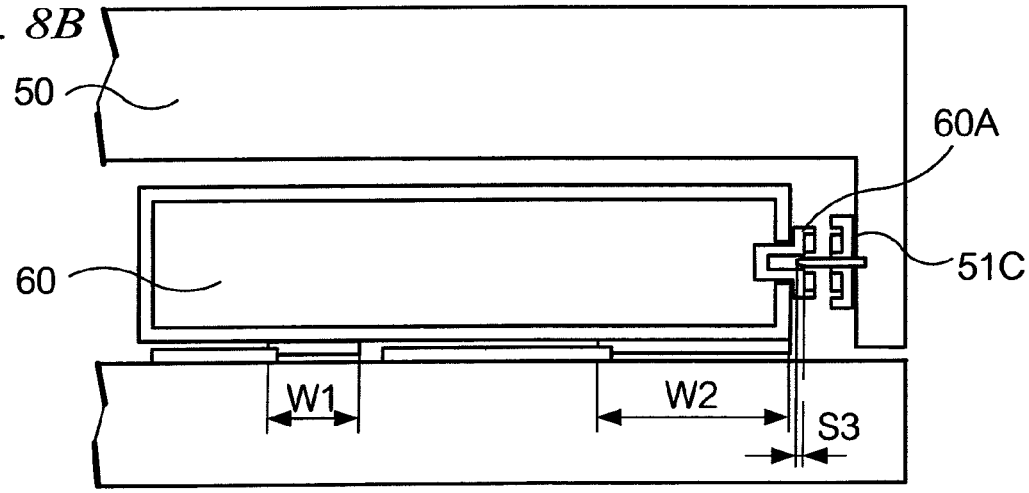
Figure 8C:
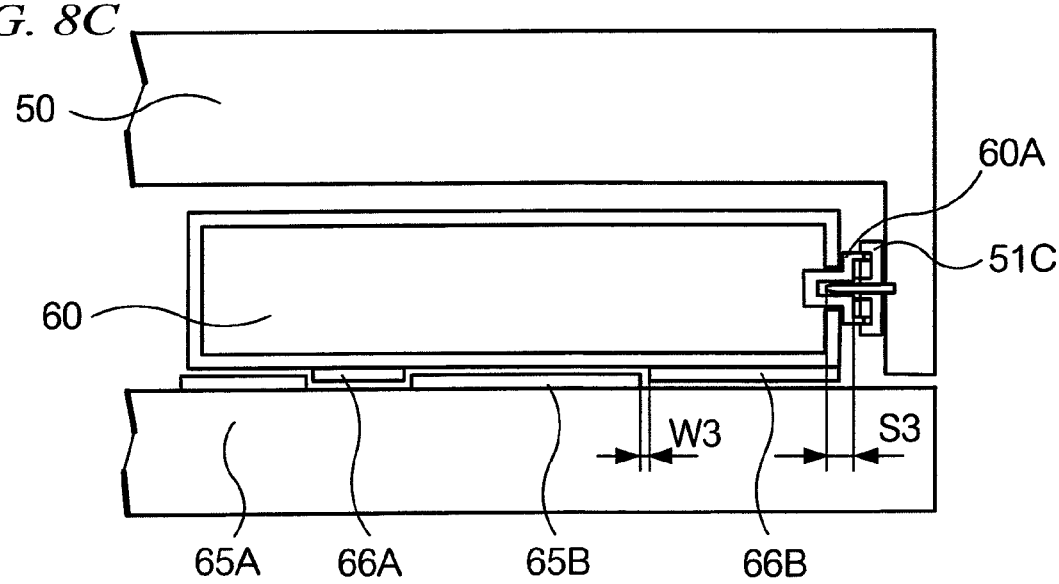

FIGS. 8A to 8C are diagrams illustrating toner cartridge 60 being inserted into developing device 55. Please note that in the drawings male coupling 51C and female coupling 60A are simplistically depicted.

When toner cartridge 60 is attached in a fixing position in developing device 55, toner cartridge 60 is inserted into rotary developing unit 50 with engaging protrusions 66A and 66B being guided by grooves 65A and 65B (see FIG. 8A).

In the process, shaft center 51C2 of male coupling 51C is inserted into recess 60A2 of female coupling 60A, before engaging protrusions 66A and 66B move out of contact with grooves 65A and 65B (see FIG. 8B). Consequently, a position of toner cartridge 60 in a direction perpendicular to an insertion direction is fixed.

After toner cartridge 60 is attached in a fixing position in developing device 55, engaging protrusions 66A and 66B are out of contact with grooves 65A and 65B, and female coupling 60A of toner cartridge 60 is coupled with male coupling 51C of rotary developing unit 50 (see FIG. 8C). Consequently, rotation caused by a rotating mechanism of developing device 55 is transmitted to a stirring auger of toner cartridge 60; however, vibration of toner cartridge 60 is not transmitted to another developing unit 55 adjacent to toner cartridge 60.

To realize the coupling of male coupling 51C and female coupling 60A described above, shaft center 51C2 of male coupling 51C and recess 60A2 of female coupling 60A are configured so that shaft center 51C2 is inserted into recess 60A2 by a length of S3, before engaging protrusions 66A and 66B move out of contact with grooves 65A and 65B, as shown in FIG. 8B. Also, shaft center 51C2 of male coupling 51C and recess 60A2 of female coupling 60A are configured so that, given that a distance between engaging protrusion 66B and groove 65B is W3, and a length by which shaft center 51C2 of male coupling 51C is inserted into recess 60A2 of female coupling 60A is S3, S3 is larger than W3, as shown in FIG. 8C.

It is to be noted that in a case where grooves 65A and 65B are formed on developing device main body 56 of developing device 55 adjacent to toner cartridge 60 (for example, developing device 55M of FIG. 2A relative to toner cartridge 60C), it is necessary to arrange grooves 65A and 65B and engaging protrusions 66A and 66B formed on toner cartridge 60 so that grooves 65A and 65B and engaging protrusions 66A and 66B are out of contact with each other when toner cartridge 60 is attached to another developing device 55, as described above. However, in a case where grooves 65A and 65B are formed on developing device main body 56 of developing device 55 to which toner cartridge 60 is attached, grooves 65A and 65B and engaging protrusions 66A and 66B formed on toner cartridge 60 may not be arranged so that grooves 65A and 65B and engaging protrusions 66A and 66B are out of contact with each other when toner cartridge 60 is attached to developing device 55.

<Replacement Hole and Replacement Door>

A replacement hole and a replacement door of multifunction machine 100 will be described.

Figure 9:
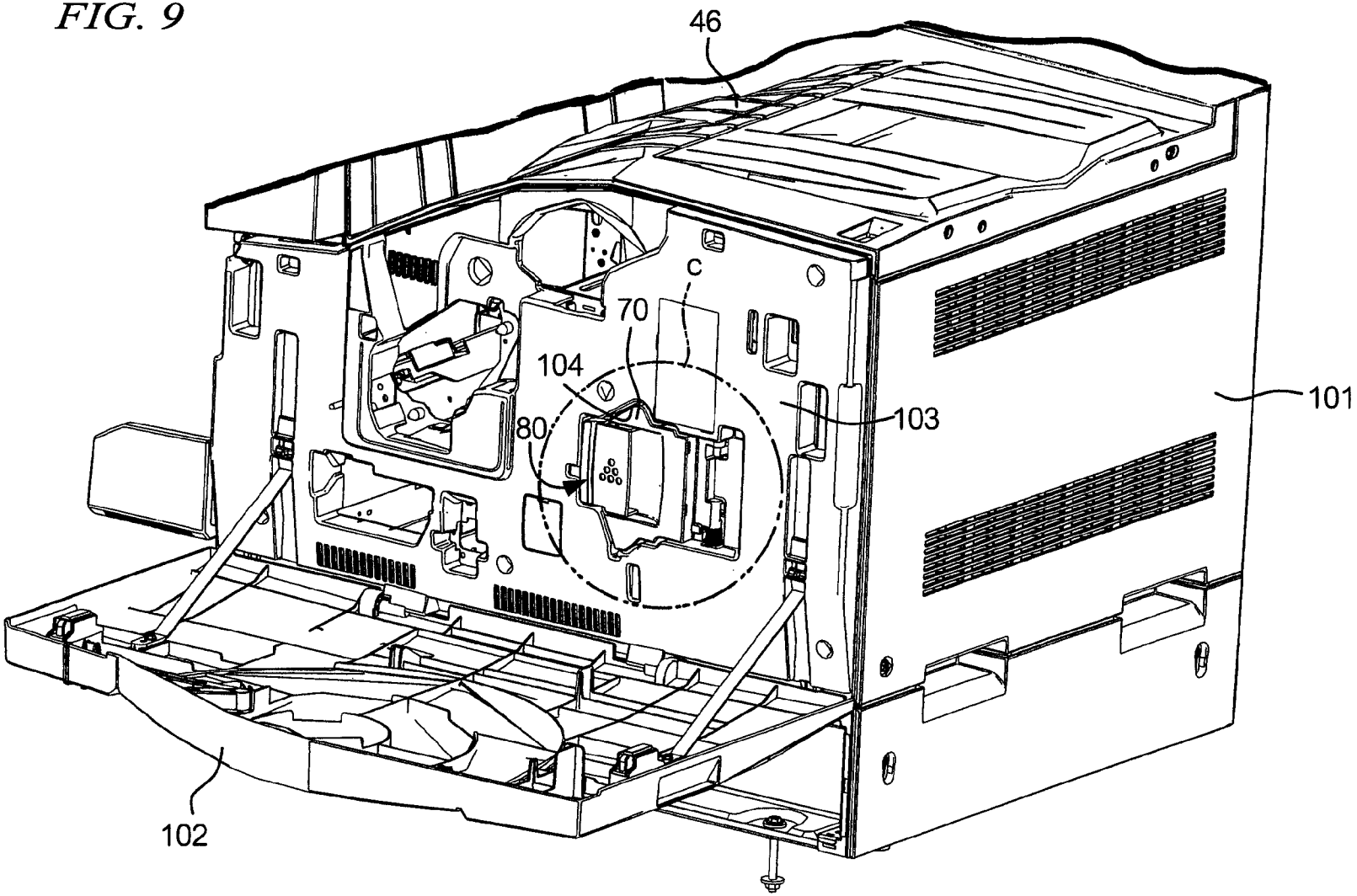
FIG. 9 is a diagram illustrating an image forming unit according to the exemplary embodiment, with an outer door open.

FIG. 9 is a diagram illustrating case 101 housing image forming unit 10 of multifunction machine 100.

Case 101 is provided with outer door 102 that opens outward. The bottom edge (on FIG. 9) of outer door 102 is pivotally supported by inner wall 103 of case 101. In a space surrounded by case 101 and inner wall 103, components of image forming unit 10 are housed. On inner wall 103 or outer door 102, outer door sensor 105 (see FIG. 17) that detects closure of outer door 102 is provided.

On inner wall 103, replacement hole 104 is provided so that after rotary developing unit 50 is rotated to a predetermined position, toner cartridge 60 can be pulled out from developing device 55 through replacement hole 104. Also, on a section of inner wall 103 adjacent to replacement hole 104, replacement door 70 is provided, that covers replacement hole 104 and opens outward. The right edge (on FIG. 9) of replacement door 70 is pivotally supported by inner wall 103.

Figure 10A:
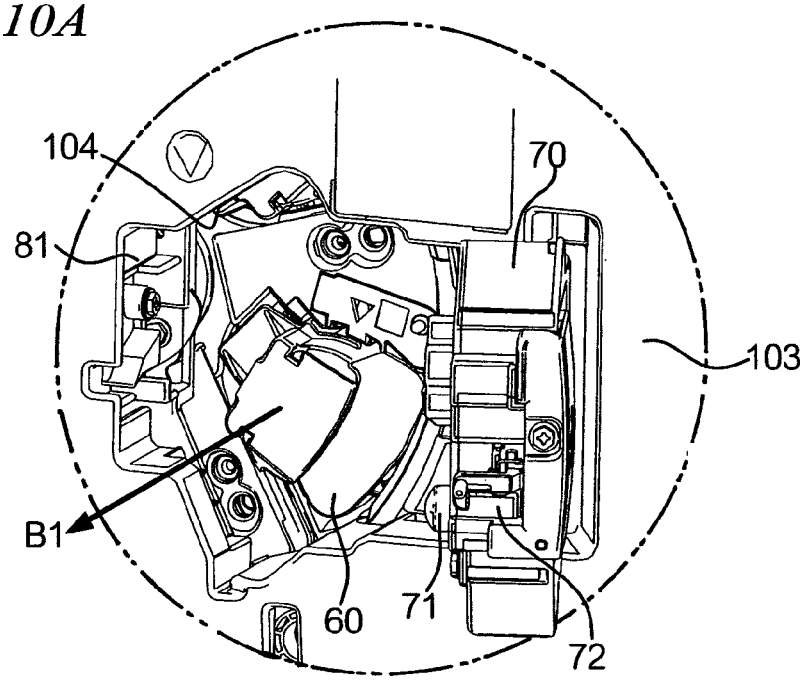
FIGS. 10A and 10B are enlarged views of section C shown in FIG. 9.
Figure 10B:
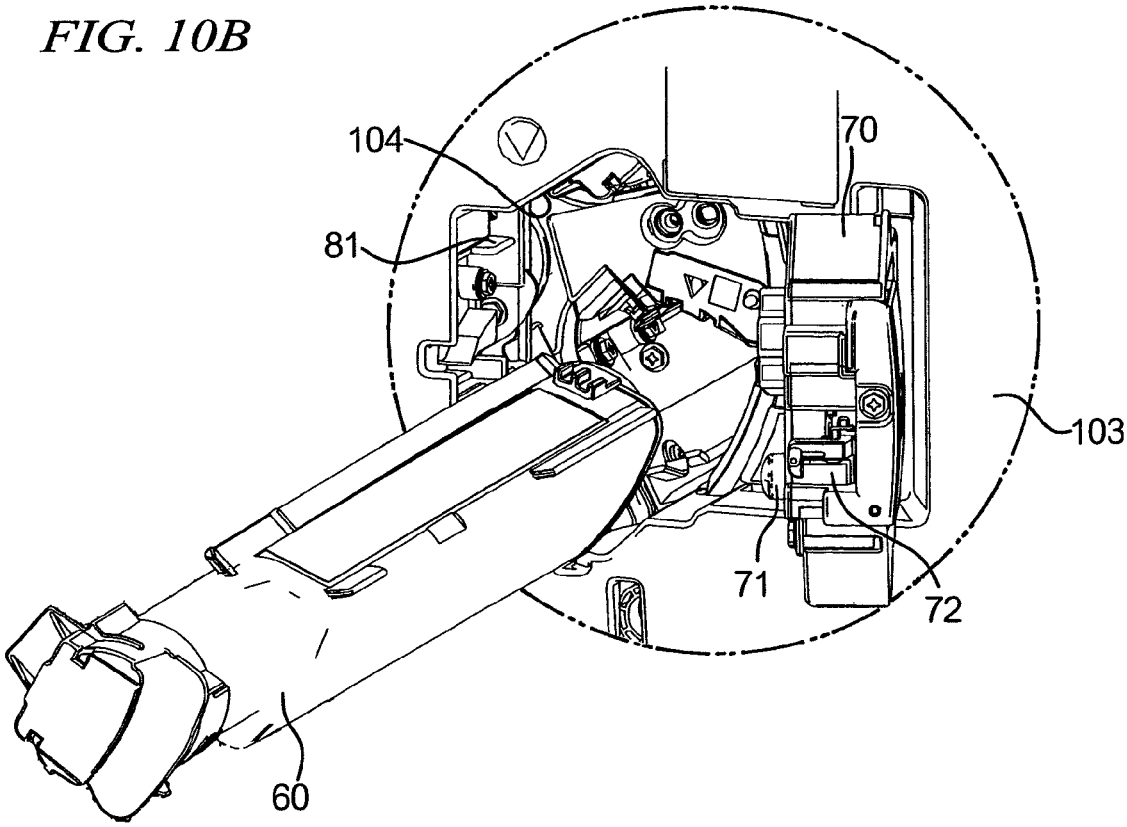

FIGS. 10A and 10B are enlarged views of section C of multifunction machine 100 shown in FIG. 9. Specifically, FIG. 10A is an enlarged view of section C of multifunction machine 100 with replacement door 70 open, and FIG. 10B is an enlarged view of section C of multifunction machine 100 from which toner cartridge 60 has been pulled out in a direction shown by arrow B1. Replacement door 70 is provided with pushing portion 71 that pushes against the back of toner cartridge 60 at a predetermined pressure.

Between an edge face of replacement door 70 and a part of inner wall 103 opposite to the edge face of replacement door 70, lock mechanism 80 for locking replacement door 70 is provided. Lock mechanism 80 includes striker 72 that is a lock structure provided at replacement door 70, and latch 81 that is another lock structure provided at a part of inner wall 103.

Figure 11:
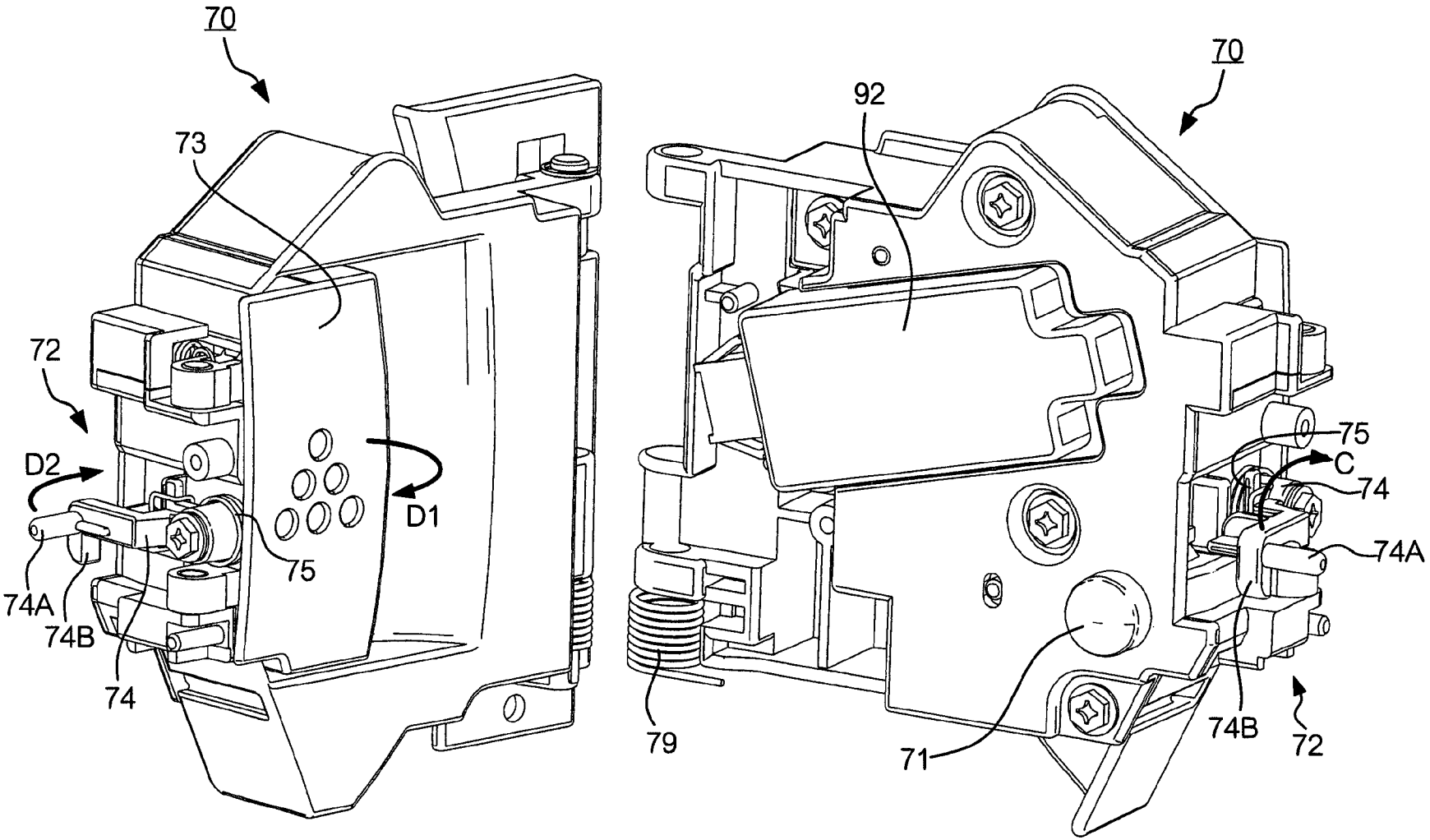
FIG. 11 is a perspective view of a replacement door according to the exemplary embodiment.

Now, a structure of replacement door 70 will be described with reference to FIG. 11. FIG. 11 shows a front perspective view and a rear perspective view of replacement door 70. Replacement door 70 has door spring 79 in the rotational center of the door, to impel the door to open outward.

Striker 72 provided on an edge face of replacement door 70 includes handle 73, striker member 74, and striker spring 75. Handle 73 is provided at replacement door 70 so as to be rotatable in a direction of arrow D1. One edge of striker member 74 is pivotally supported by handle 73, and the member rotates in a direction shown by arrow C. Striker spring 75 exerts a force to impel striker member 74 to rotate in a direction opposite to the direction shown by arrow C. Striker member 74 has protrusion 74A that projects outward, and engaging claw 74B that projects downwards.

Figure 12B:
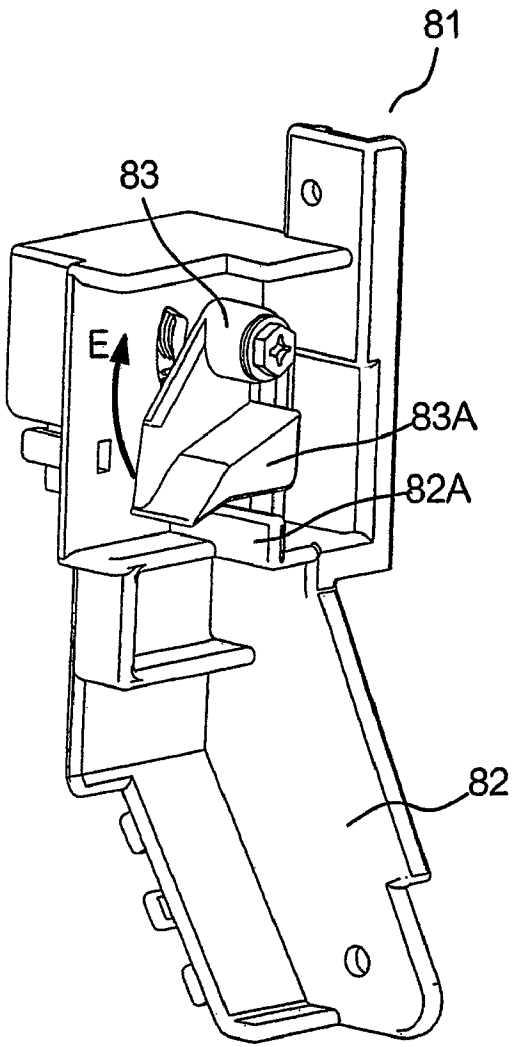
FIGS. 12A and 12B are perspective views of a latch according to the exemplary embodiment.
Figure 12A:
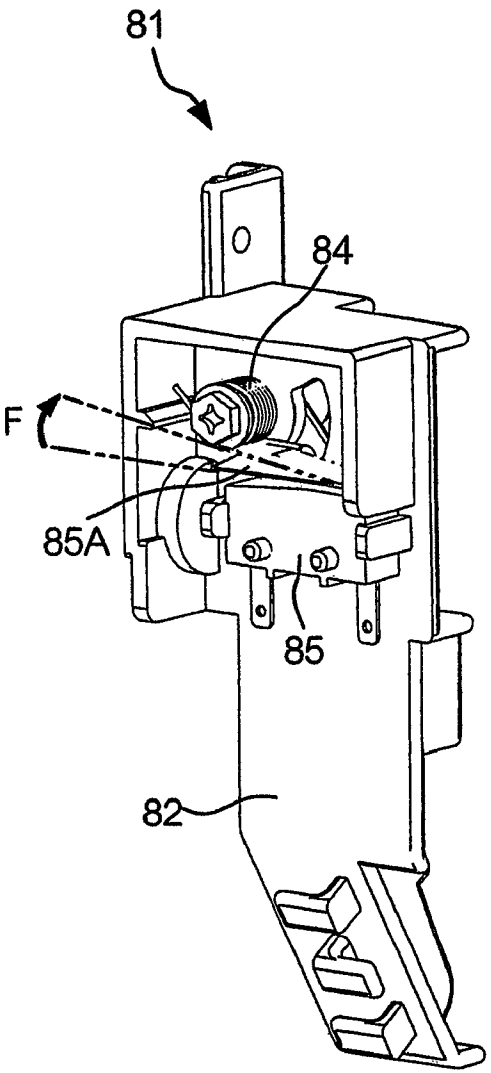

Now, a structure of latch 81 will be described with reference to FIG. 12. FIG. 12A shows a front perspective view and FIG. 12B shows a rear perspective view of latch 81.

Latch 81 includes latch base 82, latch member 83, and latch spring 84. Latch base 82 is screwed on a part of inner wall 103. One end of latch member 83 is pivotally supported by latch base 82, and the member rotates in a direction shown by arrow E. Latch spring 84 exerts a force to impel latch member 83 to rotate in a direction opposite to the direction shown by arrow E. Latch member 83 has slider 83A that has a substantially triangle shape and guides protrusion 74A of striker member 74. Slider 83A has a tilted surface. Latch base 82 has engaged portion 82A that lies closer to replacement door 70 than a position to which protrusion 74A has been pushed by slider 83A, and is engaged with engaging claw 74B of striker member 74. The force with which latch spring 84 pushes back is set to be weaker than that of striker spring 75.

On the back of latch base 82, inner door sensor 85 is provided. Inner door sensor 85 sends an on signal if latch member 83 rotates in a direction shown by arrow E, engaging claw 74B of striker member 74 is engaged with engaged portion 82A, and plate 85A is moved in a direction shown by arrow F. Inner door sensor 85 is, for example, a micro switch.

Now, movement of lock mechanism 80 will be described with reference to FIGS. 13A to 15C.

Figure 13A:
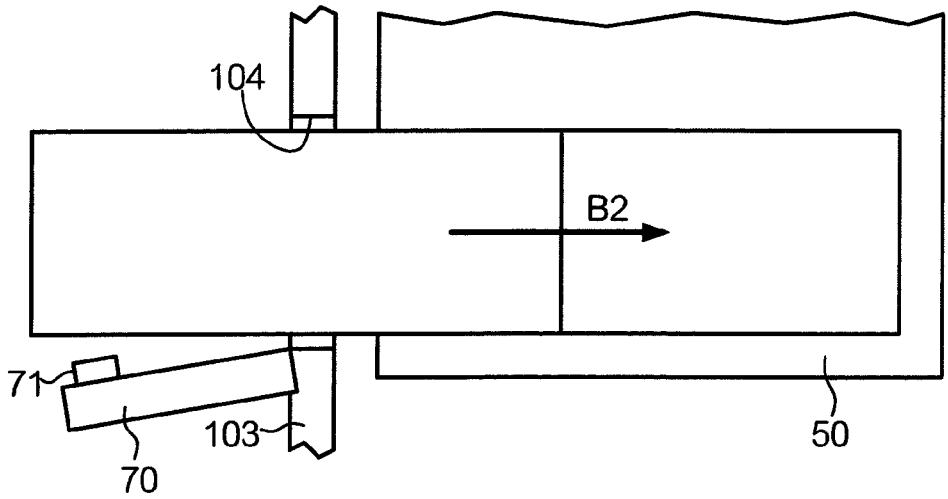
FIGS. 13A to 13C are diagrams illustrating a toner cartridge being inserted into a developing unit and a replace door.
Figure 13B:
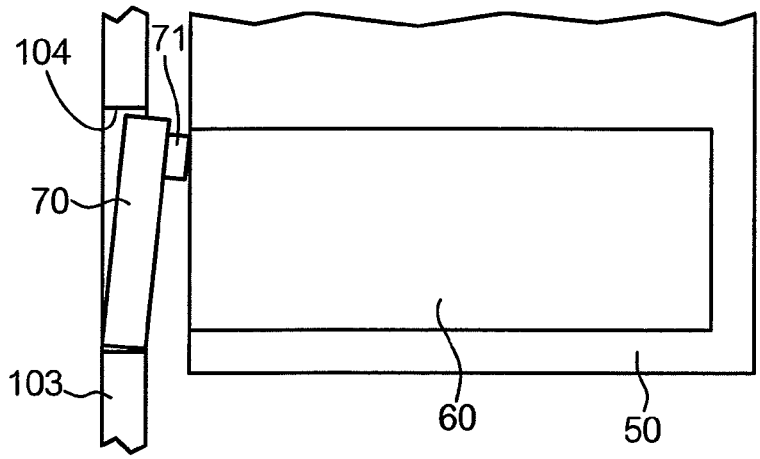
Figure 13C:
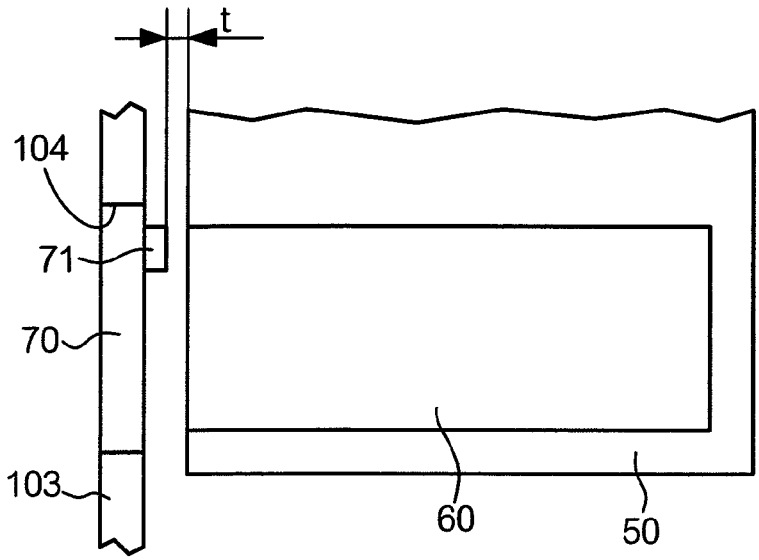

FIGS. 13A to 13C are diagrams illustrating toner cartridge 60 being attached in a fixing position in developing device 55.

A user opens outer door 102, and opens replacement door 70. When opening replacement door 70, a user pulls handle 73 in a direction shown by arrow D1. As a result, striker member 74 rotates in a direction shown by arrow D2, engaging claw 74B is disengaged from engaged portion 82A, and replacement door 70 is impelled by a force exerted by door spring 79 to open. After replacement door 70 is opened, rotary developing unit 50 is rotated to a predetermined position so that toner cartridge 60 to be replaced with another one appears in replacement hole 104.

A user pulls toner cartridge 60 attached to developing device 55, and inserts another toner cartridge 60 into rotary developing unit 50 as indicated by arrow B2 of FIG. 13A. After inserting another toner cartridge 60, a user closes replacement door 70. When closing replacement door 70, a user pushes replacement door 70 against toner cartridge 60, thereby causing toner cartridge 60 to securely attach in a fixing position in developing device 55. Pushed replacement door 70 partially returns to the outside as shown in FIGS. 13B and 13C, and is locked by lock mechanism 80. After replacement door 70 is locked, clearance t is left between replacement door 70 and rotary developing unit 50, as shown in FIG. 13C.

When toner cartridge 60 is pushed by replacement door 70, the cartridge is pushed via pushing portion 71 that has a predetermined suppressing strength. Accordingly, toner cartridge 60 is securely attached in a fixing position in developing device 55. Also, if replacement door 70 is closed hard by a user, the impact on toner cartridge 60 is absorbed by pushing portion 71.

FIGS. 14A to 14C and FIGS. 15A to 15C are diagrams illustrating movements of striker member 74 and latch member 83 of lock mechanism 80 associated with closure of replacement door 70.

Figure 14A:
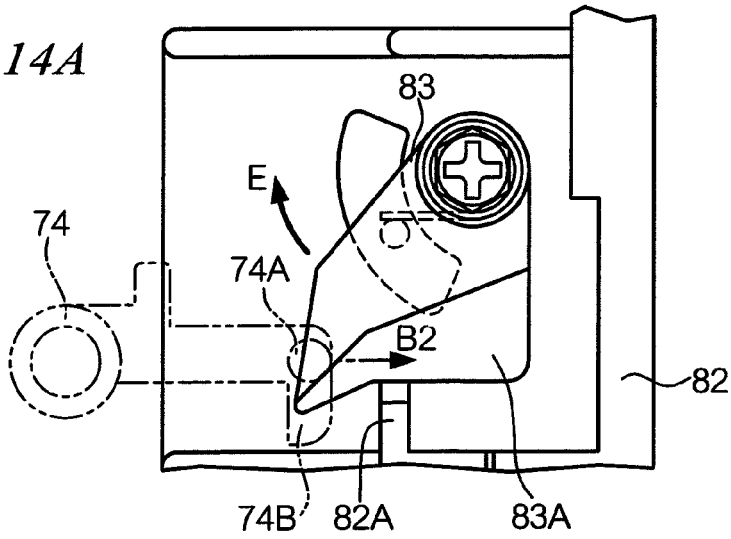
FIGS. 14A to 14C are diagrams illustrating a movement of a latch and a striker of a lock mechanism according to the exemplary embodiment.
Figure 14B:
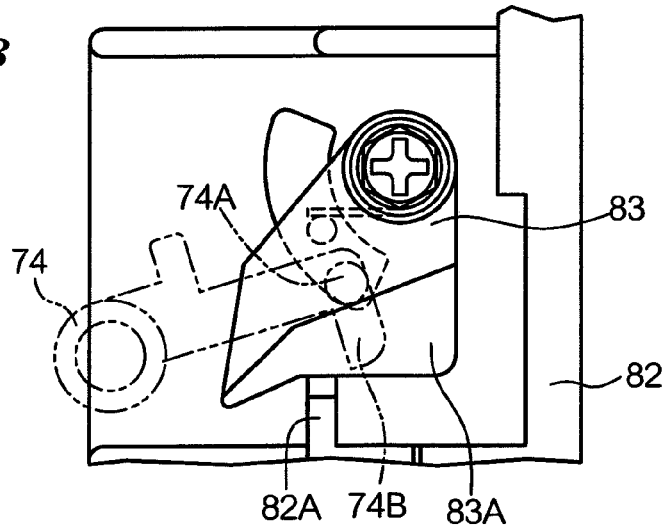
Figure 14C:
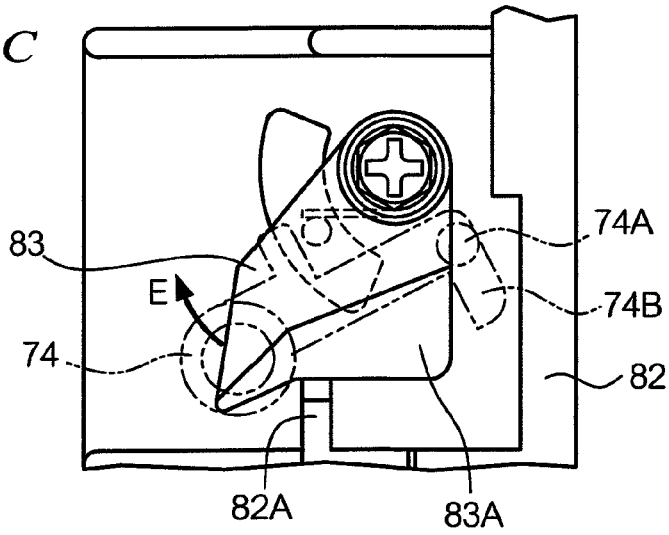

When a user closes replacement door 70, striker member 74 is moved in a direction of arrow B2. Since slider 83A of latch member 83 remains still, protrusion 74A of striker member 74 is moved in a direction shown by arrow C (see FIG. 11) along a tilted surface of slider 83A, as shown in FIG. 14A. When protrusion 74A is further moved along the tilted surface of slider 83A as shown in FIG. 14B, and reaches the top of the tilted surface of slider 83A as shown in FIG. 14C, replacement door 70 is in a state of pushing toner cartridge 60 into rotary developing unit 50 as shown in FIG. 13B. At this point, a user stops pushing replacement door 70.

Figure 15A:
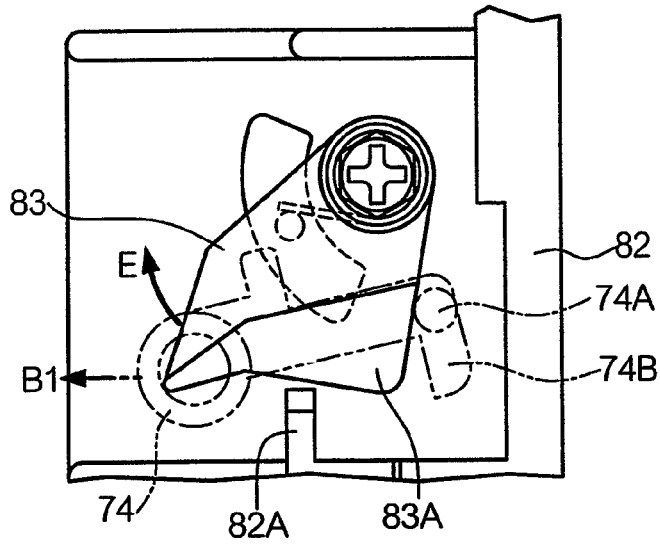
FIGS. 15A to 15C are respectively continuations of FIGS. 14A to 14C.
Figure 15B:
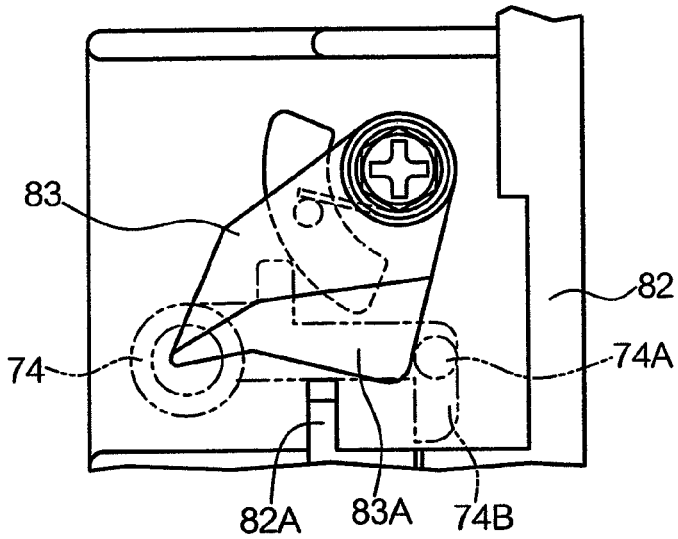
Figure 15C:
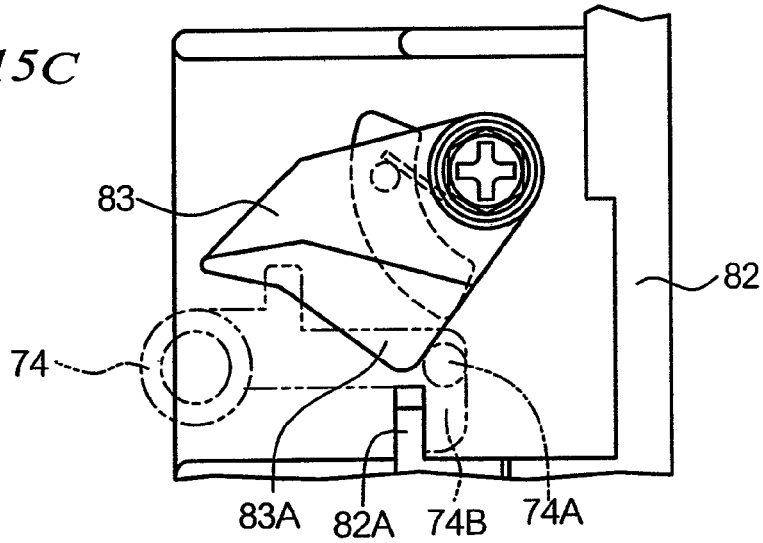

After reaching the top of the tilted surface of slider 83A, protrusion 74A of striker member 74 is impelled by a force exerted by striker 83A to fall along a vertical surface of slider 83A. At the same time, since replacement door 70 is impelled by a force exerted by door spring 79 to open outward, striker member 74 is moved in a direction of arrow B1. Consequently, the vertical surface of slider 83A is pushed by protrusion 74A in a direction of arrow B1, and latch member 83 is caused to rotate in a direction shown by arrow E, as shown in FIG. 15A. After latch member 83 is further caused to rotate in a direction shown by arrow E as shown in FIG. 15B, and engaging claw 74B of striker member 74 is engaged with engaged portion 82A of latch base 82 as shown in FIG. 15C, replacement door 70 is locked. After replacement door 70 is locked, clearance t is left between replacement door 70 and rotary developing unit 50.

As described above, when toner cartridge 60 is replaced with another one, a user pushes replacement door 70 against inserted toner cartridge 60, thereby causing toner cartridge 60 to securely attach to rotary developing unit 50, as shown in FIGS. 13A to 13C. Pushed replacement door 70 returns slightly to the outside and is locked, and clearance t is left between replacement door 70 and rotary developing unit 50.

Effects of Exemplary Embodiment

As described above, in the present exemplary embodiment, guides for guiding toner cartridge 60 into rotary developing unit 50, which includes engaging protrusions 66A and 66B and grooves 65A and 65B, are provided between toner cartridge 60 and developing device main body 56 adjacent to the cartridge. Engaging protrusions 66A and 66B and grooves 65A and 65B guide toner cartridge 60 into a fixing position in developing device 55, and are out of contact with each other when female coupling 60A of toner cartridge 60 is coupled with male coupling 51C of rotary developing unit 50. Accordingly, vibration of a stirring auger of toner cartridge 60 and vibration of an auger for stirring toner in developing device main body 56 are not transmitted to adjacent developing device 55.

In addition, since there is no need to provide partitions for dividing developing devices 55 to prevent transmission of vibration caused by one developing device 55 to another developing device 55, the cubic capacity of toner cartridge can be enlarged by the volume of the partitions.

In addition, since in the present exemplary embodiment shaft center 51C2 of male coupling 51C is inserted into recess 60A2 of female coupling 60A before engaging protrusions 66A and 66B move out of contact with grooves 65A and 65B, a position of toner cartridge 60 in a direction perpendicular to an insertion direction is fixed when the cartridge is attached to developing device 55.

In addition, since in the present exemplary embodiment, inserted toner cartridge 60 is pushed by replacement door 70 closed by a user, toner cartridge 60 is securely attached in a fixing position in developing device 55.

<Modifications>

Figure 16A:
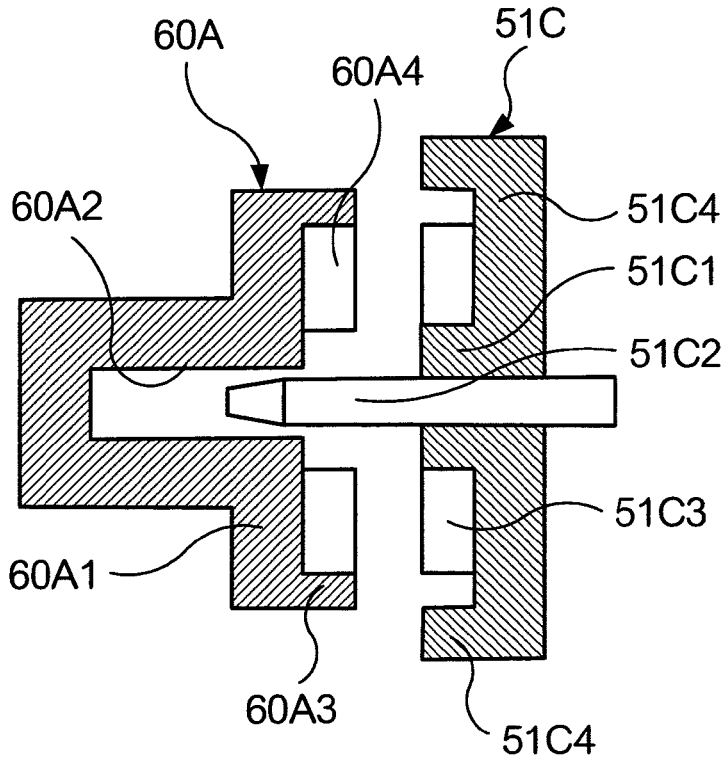
FIGS. 16A and 16B are diagrams illustrating a structure section of a coupling according to a modification.
Figure 16B:
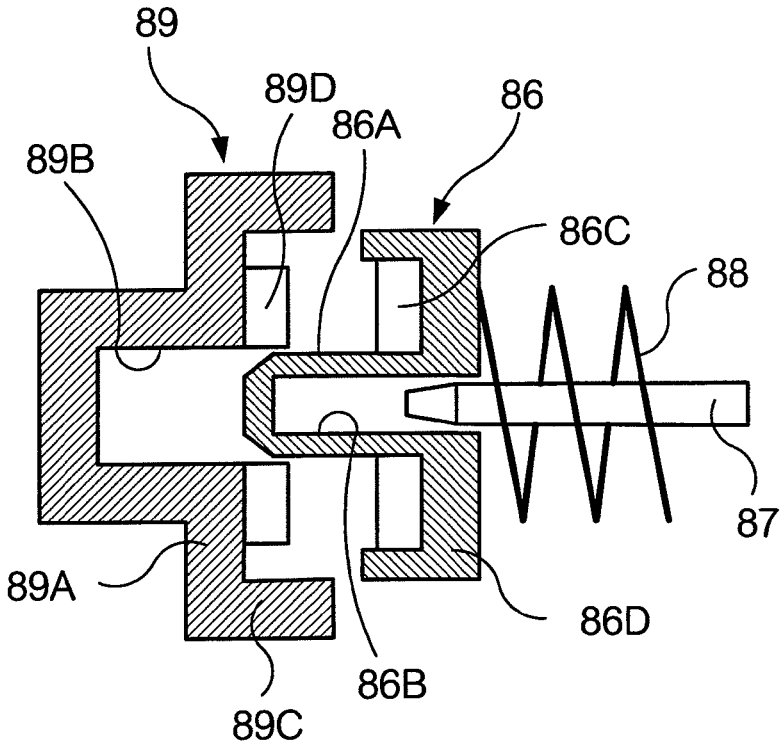

In the above exemplary embodiment, where toner cartridge 60 is attached to developing device 55 using male coupling 51C and female coupling 60A shown in FIG. 16A, toner cartridge 60 may be attached to developing device 55 using male coupling 86 and female coupling 89 shown in FIG. 16B. FIGS. 16A and 16B are deformation cross-section diagrams.

As shown in FIG. 16B, male coupling 86 has a disk-shaped form. Male coupling 86 has cylindrical base portion 86A in the center that extends in the direction of a rotation axis, and has shaft hole 86B. Base portion 86A also has equally-spaced three beams 86C that extend outward at the circumferential surface. On the outside of beams 86C, annular section 86D is provided. A tip of beam 86C has a triangle-shaped cross section. In shaft hole 86B, shaft center 87 attached to developing device 55 is inserted. Male coupling 86 is pushed by a force exerted by spring 88 attached to developing device 55 so that male coupling 86 is coupled with female coupling 89.

Female coupling 89 has a disk-shaped form, as in the case of male coupling 86. Female coupling 89 has disk portion 89A that has recess 89B into which shaft center 86A of male coupling 86 is inserted in the center. On the outside of disk portion 89A, rib 89C is provided. Disk portion 89A also has equal-spaced three engaged portions 89D that extend from rib 89C to recess 89B and have a triangular cross-section, at the periphery.

If male coupling 86 and female coupling 89 are configured so that base portion 86A of male coupling 86 is inserted into recess 89B of female coupling 89 before engaging protrusions 66A and 66B move out of contact with grooves 65A and 65B, it is possible to fix a position of toner cartridge 60 in a direction perpendicular to an insertion direction when the cartridge is attached to developing device 55, as in the case of male coupling 51C and female coupling 60A of the above exemplary embodiment.

It is to be noted that the structures of couplings are not limited to those of male coupling 51C and female coupling 60A and those of male coupling 86 and female coupling 89. Couplings may have any structures, if the structures enable the couplings to transmit rotation caused by a rotating mechanism of developing device 55 to a stirring auger of toner cartridge 60, and enable parts of the couplings to be engaged with each other before engaging protrusions 66A and 66B move out of contact with grooves 65A and 65B.

Figure 17:
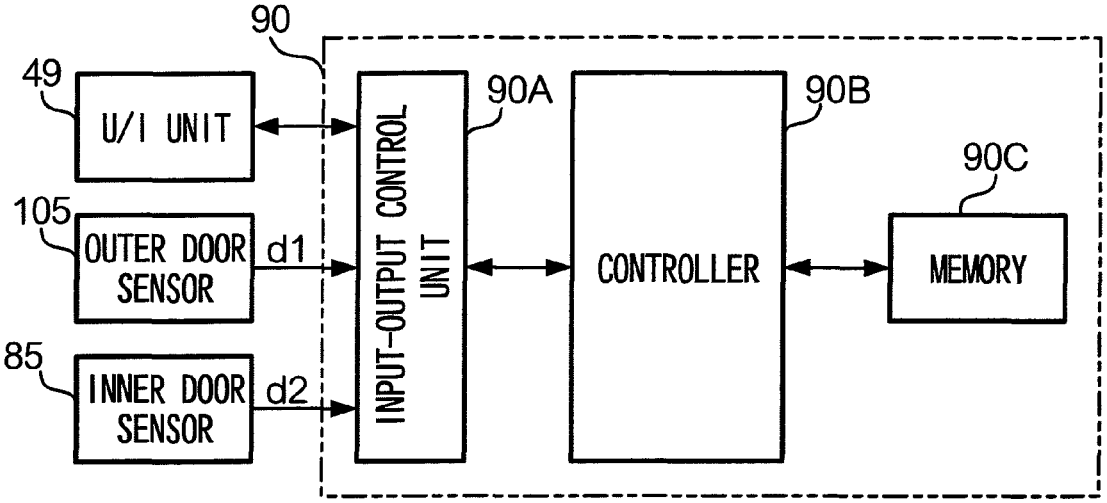
FIG. 17 is a control block diagram according to a modification.
Figure 18:
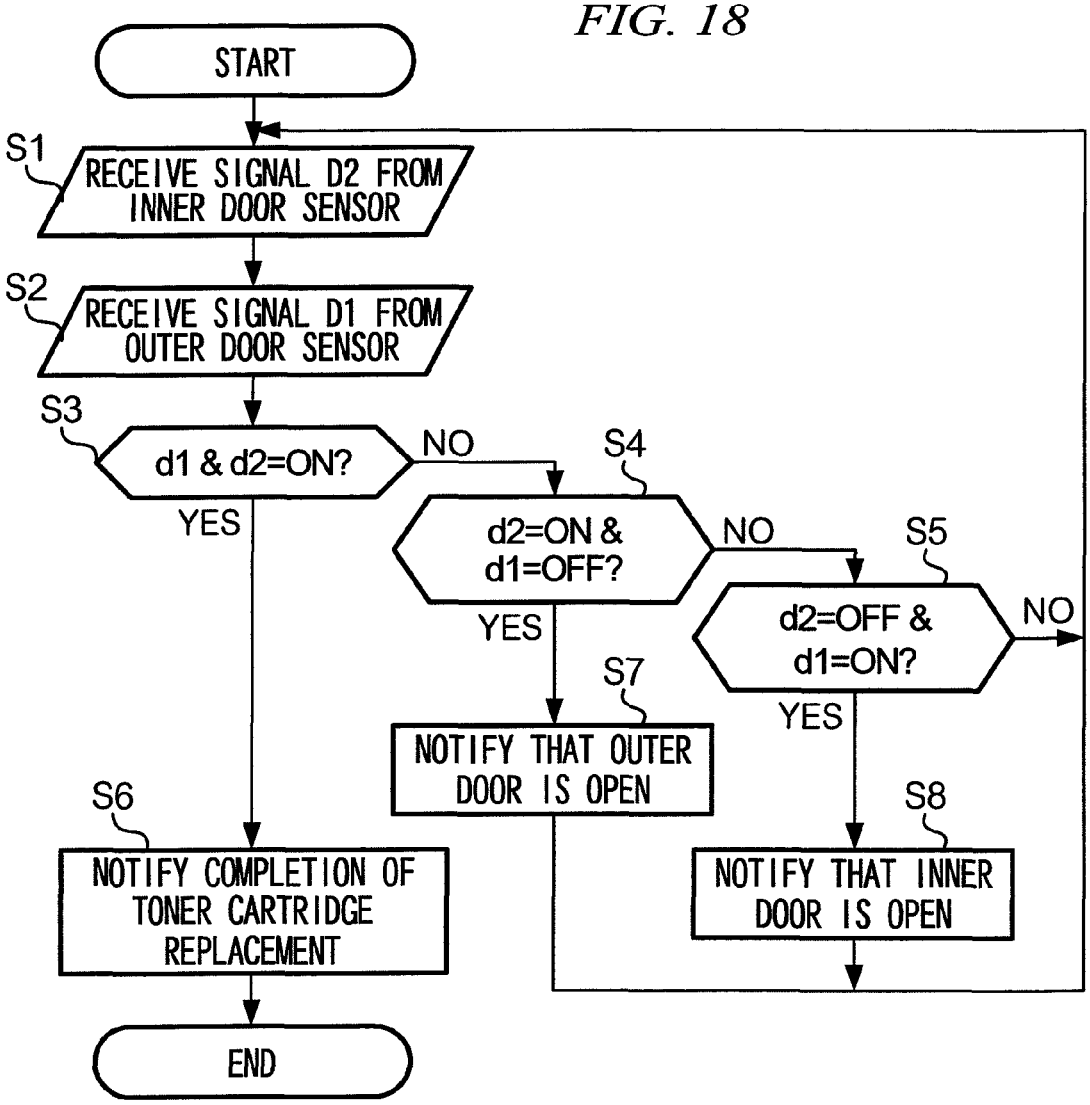
FIG. 18 is a flowchart according to a modification.

In the above exemplary embodiment, completion of a cartridge replacement may be determined using controller 90. FIG. 17 is a control block diagram, and FIG. 18 is a flowchart illustrating a cartridge replacement process.

Controller 90 includes a CPU, a ROM, and a RAM, and serves as an input-output control unit 90A, controller B, and memory 90C. Input-output control unit 90A is connected to U/I unit 49, outer door sensor 105, and inner door sensor 85. Memory 90C stores a program for a cartridge replacement process.

U/I unit 49 is a user interface by which a user operates multifunction machine 100. U/I unit 49 includes a liquid crystal display with a touch panel as shown in FIG. 1.

Now, a cartridge replacement process will be described with reference to FIG. 18.

Controller 90 receives signal d2 from inner door sensor 85 (step S1), and receives signal d1 from outer door sensor 105 (step S2).

Controller 90 determines whether both signals d1 and d2 are on signals (step S3), whether only signal d2 is an on signal (step S4), or whether only signal d1 is an on signal (step S5).

If the determination at step S3 is affirmative, namely, if both doors 70 and 102 are closed, controller 90 causes U/I unit 49 to display a message notifying a user that a cartridge replacement has been completed (step S6). If the determination at step S4 is affirmative, namely, if replacement door 70 is closed and outer door 102 is open, controller 90 causes U/I unit 49 to display a message notifying a user that outer door 102 is open (step S7). If the determination at step S5 is affirmative, namely, if replacement door 70 is open and outer door 102 is closed, controller 90 causes U/I unit 49 to display a message notifying a user that replacement door 70 is open (step S8). If the determination at step S5 is negative; namely, if both doors 70 and 102 are open, controller 90 again carries out an operation of step S1.

In the above exemplary embodiment, reader 92 for reading data from an IC tag may be attached on the inner side of replacement door 70, as shown in FIG. 11. In this case, an IC tag may be attached to the back in an insertion direction of toner cartridge 60, and the IC tag may store data such as a color of toner, a type of toner, a type of cartridge, an amount of used toner, a manufacturer etc. Alternatively, a reader/writer for reading and writing data from/in an IC tag may be attached on the inner side of replacement door 70.

In the above exemplary embodiment, where inner door sensor 85 is attached to latch 81 of lock mechanism 80, inner door sensor 85 may be attached to striker 72 of lock mechanism 80, replacement door 70, or inner wall 103.

In the above exemplary embodiment, where the right edge of replacement door 70 is pivotally supported by inner wall 103, the top edge or the bottom edge of replacement door 70 may be pivotally supported by inner wall 103.

In the above exemplary embodiment, where a toner image is transferred to intermediate transfer belt 16 from photosensitive drum 11, a toner image may be transferred directly to a recording sheet from photosensitive drum 11.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principle of the invention and its practical application, thereby enabling others skilled in the art to understand the invention for various embodiments and with the various modifications as are suited to the particular use contemplated. It is intended that the scope of the invention be defined by the following claims and their equivalents.

What is claimed is:

1. A rotary developing unit comprising:

a rotary body that rotates around a rotation axis;

a first developing device arranged on a circumferential surface of the rotary body, comprising:

a first toner storage chamber that houses toner supplied from a first toner entry port; and a first developer holder that develops an electrostatic latent image formed on an image holder with toner supplied from the first toner storage chamber;

a second developing device arranged on a circumferential surface of the rotary body, comprising:

a second toner storage chamber that houses toner supplied from a second toner entry port; and a second developer holder that develops an electrostatic latent image formed on an image holder with toner supplied from the second toner storage chamber;

a toner supply container that is inserted between the first developing device and the second developing device in an insertion direction substantially parallel to that of the rotation axis to be attached to the first developing device, and that supplies toner to the first toner storage chamber of the first developing device through a supply port of the toner supply container and the first toner entry port of the toner storage chamber;

a first guide formed on the toner supply container;

a second guide formed on the second developing device, that is configured to slide along the first guide when the toner supply container is inserted between the first developing device and the second developing device, and to be detached from the first guide before the toner supply container is attached to the first developing device;

a first position fixing unit provided at the first developing device; and a second position fixing unit provided at the toner supply container, that is configured to fix a position of the toner supply container in a direction substantially perpendicular to the insertion direction, in cooperation with the first position fixing unit of the first developing device, before the second guide of the second developing device is detached from the first guide.

2. The rotary developing unit according to claim 1, further comprising:

a third guide formed on the first developing device; and a fourth guide formed on the toner supply container, that is configured to slide along the third guide when the toner supply container is inserted between the first developing device and the second developing device.

3. The rotary developing unit according to claim 1, wherein:

the first guide is a pair of grooves that extend in the insertion direction;

the second guide is a pair of plates that extend in the insertion direction;

the first position fixing unit has a shaft that extends in the insertion direction; and the second position fixing unit has a recess into which the shaft of the first position fixing unit is to be inserted before the second guide is detached from the first guide.

4. The rotary developing unit according to claim 3, wherein the shaft of the first position fixing unit and the recess of the second position fixing unit are configured so that, given that a distance in the insertion direction between the first guide and the second guide is A, and length by which the shaft of the first position fixing unit is inserted into the recess is B, B is larger than A.

5. A toner supply container comprising:

a main body that houses toner to be supplied to a first developing device, the first developing device being arranged on a circumferential surface of a rotary body that rotates around a rotation axis;

a first guide configured to slide with a second guide formed on a second developing device arranged on the circumferential surface of the rotary body when the toner supply container is inserted between the first developing device and the second developing device in an insertion direction substantially parallel to that of the rotation axis to be attached to the first developing device, and to move out of contact with the second guide of the second developing device before the toner supply container is attached to the first developing device; and a first position fixing unit configured to fix a position of the toner supply container in a direction substantially perpendicular to the insertion direction, in cooperation with a second position fixing unit provided at the first developing device, before the first guide moves out of contact with the second guide of the second developing device.

6. The toner supply container according to claim 5, wherein:

the first guide is a pair of plates that extend in the insertion direction;

the second guide is a pair of grooves that extend in the insertion direction;

the first position fixing unit has a recess; and the second position fixing unit has a shaft that extends in the insertion direction and that is to be inserted into the recess of the first position fixing unit before the first guide moves out of contact with the second guide.

7. A rotary developing unit comprising:

a rotating means for rotating around a rotation axis;

a first developing means arranged on a circumferential surface of the rotating means, comprising:

a first toner storing means for housing toner supplied from a first toner entry port; and a first developer holding means for developing an electrostatic latent image formed on an image holder with toner supplied from the first toner storing means;

a second developing means arranged on a circumferential surface of the rotating means, comprising:

a second toner storing means for housing toner supplied from a second toner entry port; and a second developer holding means for developing an electrostatic latent image formed on an image holder with toner supplied from the second toner storing means;

a toner containing means that is inserted between the first developing means and the second developing means in an insertion direction substantially parallel to that of the rotation axis to be attached to the first developing means, for supplying toner to the first toner storing means of the first developing means through a supply port of the toner containing means and the first toner entry port of the toner storing means;

a first guide means formed on the toner containing means;

a second guide means formed on the second developing means, that is configured to slide along the first guide when the toner containing means is inserted between the first developing means and the second developing means, and to be detached from the first guide means before the toner containing means is attached to the first developing means;

a first position fixing means provided at the first developing means; and a second position fixing means provided at the toner containing means, that is configured to fix a position of the toner containing means in a direction substantially perpendicular to the insertion direction, in cooperation with the first position fixing means of the first developing means, before the second guide means of the second developing means is detached from the first guide means.

* * * * *